US007531276B2

(12) United States Patent
Ishiyama et al.

(10) Patent No.: US 7,531,276 B2
(45) **Date of Patent: *May 12, 2009**

(54) COLOR IMAGE FORMING METHOD AND COLOR TONER FORMING METHOD

(75) Inventors: Takao Ishiyama, Minamiashigara (JP); Masanobu Ninomiya, Minamiashigara (JP); Hiroshi Nakazawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 412 days.

This patent is subject to a terminal disclaimer.

(21) Appl. No.: 11/246,141

(22) Filed: Oct. 11, 2005

(65) Prior Publication Data

US 2006/0275679 A1 Dec. 7, 2006

(30) Foreign Application Priority Data

Jun. 2, 2005 (JP) ..... 2005-162762

(51) Int. Cl.
*G03G 15/20* (2006.01)

(52) U.S. Cl. ..... 430/42.1; 430/124.1; 430/137.14

(58) Field of Classification Search ..... 430/42, 430/137, 14, 124.1, 42.1
See application file for complete search history.

(56) References Cited

U.S. PATENT DOCUMENTS

| | | | | |
|---|---|---|---|---|
| 6,438,274 | B1 | 8/2002 | Tokuyama et al. | |
| 6,549,657 | B2 | 4/2003 | Ohta et al. | |
| 6,608,941 | B1 | 8/2003 | Suzuki et al. | |
| 2003/0039910 | A1* | 2/2003 | Shirai et al. | 430/109.4 |
| 2003/0039913 | A1* | 2/2003 | Kadokura et al. | 430/124 |
| 2004/0051902 | A1 | 3/2004 | Sasaki | |
| 2005/0142478 | A1* | 6/2005 | Matsumura et al. | 430/124 |
| 2006/0063087 | A1* | 3/2006 | Ninomiya et al. | 430/109.4 |

FOREIGN PATENT DOCUMENTS

| | | |
|---|---|---|
| JP | B2 4-24702 | 4/1992 |
| JP | A 8-234480 | 9/1996 |
| JP | A 9-325520 | 12/1997 |
| JP | A 10-123748 | 5/1998 |
| JP | A 2000-267482 | 9/2000 |
| JP | A 2003-156880 | 5/2003 |
| JP | A 2003-189103 | 7/2003 |
| JP | A 2004-001260 | 1/2004 |

* cited by examiner

*Primary Examiner*—John L Goodrow
(74) *Attorney, Agent, or Firm*—Oliff & Berridge, PLC

(57) ABSTRACT

The invention provides a color image forming method including charging, developing, transferring and fixing. The fixing includes thermally fixing a toner image to paper by using a heating body and a pressurizing member which is positioned opposite to the heating body via a film-like member. The color toner includes a toner particle containing a crystalline resin and a non-crystalline resin. When the color toner is subjected to dynamic viscoelasticity measurement employing a sine wave vibration method, a minimum value of the relaxation elasticity H in a relaxation spectrum obtained from frequency dispersion characteristics when a measurement frequency measured at 60 and 80° C. is 0.1 to 100 rad/sec and a measurement strain at a frequency of 6.28 rad/sec is 0.1 %, is in a range of about 10 to 900 Pa/cm$^2$. A relaxation time λ corresponding to the minimum value is in a range of about 1 to 10,000 sec.

16 Claims, 1 Drawing Sheet

COLOR IMAGE FORMING METHOD AND COLOR TONER FORMING METHOD

CROSS-REFERENCE TO RELATED APPLICATION

This application claims priority under 35 USC 119 from Japanese Patent Application No. 2005-162762, the disclosure of which is incorporated by reference herein.

BACKGROUND OF THE INVENTION

1. Field of Invention

The present invention relates to an image forming method for electrophotography and an apparatus and a developer which are used for the method.

2. Description of the Related Art

Conventionally known full color development methods include, for example, a method of forming a full color image by successively developing single color toners on a photoconductor and then transferring the image to an image transfer body such as paper or an OHP film; and a method of forming a full color image by successively transferring monochromic images formed on a photoconductor to an image transfer body such as paper or a film or once transferring the images to an intermediate transfer material to form superimposed images and then collectively transferring the images to paper or a film.

The image transferred to the image transfer body such as paper or OHP film in the above-mentioned methods is fixed on the image transfer body through a fixation process. As a fixation method of fixing a color image on a transfer body in electrophotography, thermal fixation is generally employed because of the simplicity of the apparatus and high heat efficiency and, in particular, thermal roller fixation by which heat and pressure can be simultaneously applied is employed. The temperature to be imparted by a thermal roller depends on the glass transition temperature (Tg) of the toner materials and the Theological properties of the binder resin such as melting point or molecular weight in the case of a crystalline resin, and it is generally required to be about 150 to 200° C.

However, thermal roller fixation requires a large quantity of thermal energy when heating the roller to the above-mentioned temperature. Further, in the portions of the roller where the roller is brought into contact with the image transfer body, the thermal energy is used for the image transfer body and fixation of the toner, so that the roller temperature decreases; however the temperature decrease is slight in the non-contacting portions. As a result, the temperature difference between portions of the roller contacting and not contacting the image transfer body becomes large. To compensate for the temperature difference, heating by a heating member in the thermal roller is carried out. However, since the non-contacting portions are also heated thereby, the temperature in the non-contacting portions further increases to possibly result in image defects known as hot-offset. Excess thermal energy supply is also undesirable in terms of energy saving.

Accordingly, a fixation system, in which the thermal energy for a roller is saved so as to shorten the warm up time and suppress total thermal energy, has been proposed (see, for example, Japanese Patent Application Laid-Open No. 2000-267482). This fixation system is a method of carrying out fixation using a heat resistant film wherein an image transfer body is pinched and transferred by a heating body formed through a film and a pressure-contact part (hereinafter, referred to as a fixation nip part) of a pressurizing means and accordingly thermal energy of the heating body is supplied to an un-fixed image (a toner image) on the image transfer body to soften and melt-deposit the un-fixed image and, further, when the image transfer body is discharged from the fixation nip part, the un-fixed image is cooled and solidified to fix it onto the image transfer body. With such a film use-type fixation apparatus, a warm up time is not required since the film and the heating body have a low thermal capacity, and an energy saving can be achieved since heat efficiency can be improved because the distance between the toner image and the heating body is short.

Since the method is excellent in energy saving and lowers the total heat quantity to a certain extent, it is possible to reduce the temperature difference between the contact and the non-contact portions of the image transfer body to a certain extent. However, the effect is still insufficient. Particularly, in the case of a high gloss toner, which aims at high level gloss exhibition, hot offset due to the temperature difference of the roller becomes a problem.

To deal with this problem, in order to improve the toner properties, methods have been proposed so as to improve an anti-hot offset property by controlling the molecular weight distribution of a binder resin, by improving the melting point, and/or by adding the amount of a release agent. However, in application of a toner having high gloss in oil-less fixation, those methods cannot be said to be sufficiently effective.

SUMMARY OF THE INVENTION

The invention has been accomplished in account of the above-described circumstances. The invention provides a color image formation method capable of forming images with stable coloration and high gloss for a long term while suppressing excess thermal energy supply. The invention also provides a production method of a color toner usable for the color image formation method.

The present invention provides a color image forming method comprising: charging a photosensitive body so as to form a latent image; developing the latent image with a color toner so as to form a toner image on the photosensitive body; transferring the toner image to paper via an intermediate transfer body so as to form a non-fixed transfer image; and fixing the non-fixed transfer image to the paper, wherein: the fixing comprises thermally fixing the toner image to the paper by using: a heating body installed in a fixed manner for heating the transfer body; and a pressurizing member which is positioned opposite to the heating body via a film-like member, brought into contact with the heating body with pressure, and rotated so as to press-contact the transfer body to the heating body; the color toner comprises a toner particle comprising a crystalline resin and a non-crystalline resin as binder resins; when the color toner is subjected to dynamic viscoelasticity measurement employing a sine wave vibration method, a minimum value of the relaxation elasticity H in a relaxation spectrum obtained from frequency dispersion characteristics when a measurement frequency measured at 60 and 80° C. is 0.1 to 100 rad/sec and a measurement strain at a frequency of 6.28 rad/sec is 0.1%, is in a range of about 10 to 900 Pa/cm$^2$; and a relaxation time $\lambda$ corresponding to the minimum value is in a range of about 1 to 10,000 sec.

The color toner used in the present invention can be formed by a method comprising: aggregating respective particles in a releasing agent dispersion by using aluminum ions in a mixture that is obtained by mixing a colorant dispersion, the releasing agent dispersion, and a resin particle dispersion comprising crystalline resin particles and first non-crystalline resin particles, so as to form aggregated particles; adhering second non-crystalline resin particles to the aggregated particles; and coalescing the second non-crystalline resin particles to the aggregated particles by terminating growth of the aggregated particles adhered to the second non-crystalline resin particles and then heating to a temperature which is equal to or higher than a glass transition temperature of the second non-crystalline resin particles, wherein: an average diameter of each of the crystalline resin particles, the first non-crystalline resin particles and the second non-crystalline resin particles is equal to or less than 1 μm; and the second non-crystalline resin particles have a different solubility parameter SP value from that of the aggregated particles.

The invention makes it possible to form an image having a stable high glossiness for over a long period by employing a fixation method which causes little heat transmission and conducts thermal fixation of a toner image on a transfer body by using a heating body installed in a fixed manner for heating the transfer body, and a pressurizing member which faces the heating body via a film-like member and which is brought into contact with the heating body with pressure and rotated so as to press-contact the transfer body to the heating body, as well as by controlling the dynamic visco-elasticity of the toner.

According to the invention, it is also made possible to provide a color image formation method capable of forming an image having a stable high glossiness for over a long period and with suppression of excess thermal energy supply, and a production method of a color toner usable for the color image formation method.

DETAILED DESCRIPTION OF THE INVENTION

Figure 1:
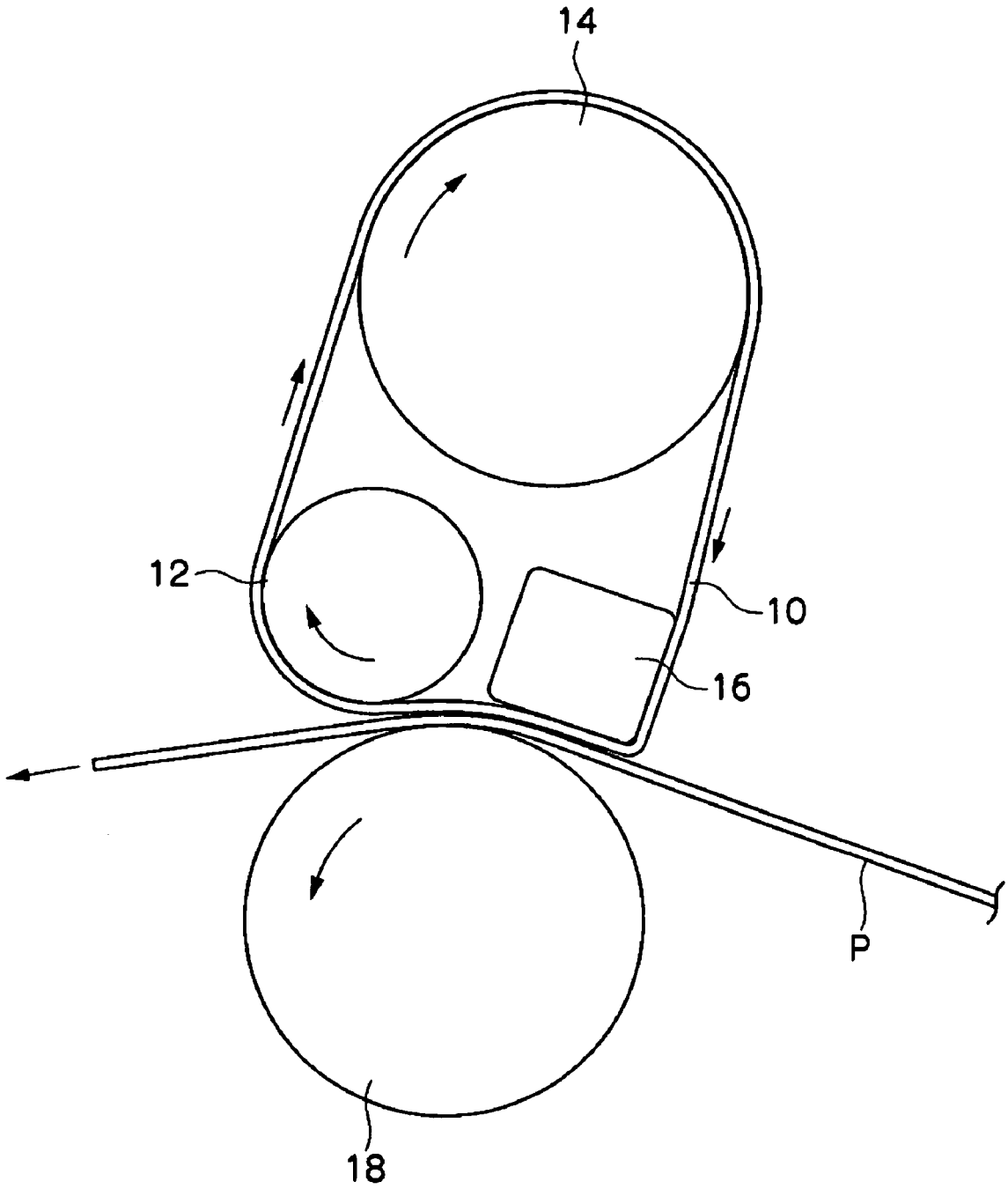
FIG. 1 A schematic view of one embodiment of a fixation apparatus used in Examples of the image forming method of the invention.

The color image forming method of the present invention at least includes: charging a photosensitive body so as to form a latent image; developing the latent image with a color toner so as to form a toner image on the photosensitive body; transferring the toner image to paper via an intermediate transfer body so as to form a non-fixed transfer image; and fixing the non-fixed transfer image to the paper. The fixing at least includes thermally fixing the toner image to the paper by using: a heating body installed in a fixed manner for heating the transfer body; and a pressurizing member which is positioned opposite to the heating body via a film-like member, brought into contact with the heating body with pressure, and rotated so as to press-contact the transfer body to the heating body. The color toner at least includes a toner particle comprising a crystalline resin and a non-crystalline resin as binder resins. When the color toner is subjected to dynamic viscoelasticity measurement employing a sine wave vibration method, a minimum value of the relaxation elasticity H in a relaxation spectrum obtained from frequency dispersion characteristics when a measurement frequency measured at 60 and 80° C. is 0.1 to 100 rad/sec and a measurement strain at a frequency of 6.28 rad/sec is 0.1%, is in a range of about 10 to 900 Pa/cm$^2$. A relaxation time λ corresponding to the minimum value is in a range of about 1 to 10,000 sec.

In the fixation method, since the heating body is brought into contact with the toner image only through the film-like member, which is a heat transmission member and is in a form of a thin layer, the heating body and the toner image are in very proximal positions. Accordingly, the heat transmission efficiency becomes high and it becomes unnecessary to supply heat beyond what is needed, and even if the heating body is installed at a position adjacently to the belt-like intermediate transfer body, the heat transmission can be lessened and thus thermal deformation of the belt-like intermediate transfer body can be prevented.

Further, in the fixation method, since a thin layer film-like member is inserted, the temperature difference between the contact portions and the non-contact portions in the image transfer body is decreased and the time taken to reach a prescribed temperature, that is, the warm-up time, is practically non-existent or very short time. Therefore, no heat is generated in the fixation portion during waiting, which results in further decrease of the total thermal energy supply.

More specifically, the heating body installed in a fixed manner in the image formation apparatus to be employed in the invention is preferably a line-like heating body with a low heat capacity comprising an aluminum base substrate with a thickness of approximately 0.1 mm to 6.0 mm, and more preferably approximately 0.7 mm to 4.0 mm, a width of approximately 15 mm to 20 mm, and a longitudinal direction of approximately 295 to 315 mm and a resistance material applied to a thickness of approximately 1.5 to 2.0 mm, and more preferably approximately 1.6 to 1.8 mm, on the base substrate.

Heating of the heating body is carried out by applying electricity from both ends and the electricity application is carried out using a pulsed waveform of DC 100 V at approximately 20 to 25 msec frequency by changing the pulse width in accordance with the temperature-energy release quantity that is controlled by a thermo-sensor.

In the case of the temperature T1 detected by the thermo-sensor in the line-like heating body with a low heat capacity, the surface temperature T2 of the film-like member to be brought into contact with the resistance material becomes slightly lower than T1. In this case, T1 is preferably approximately 100° C. to 200° C., and more preferably approximately 190° C. The temperature T2 is preferably lower than the temperature T1 by approximately 10° C. to 20° C. for offset prevention at a high temperature.

The surface temperature T3 of the film-like member in the part parted from the toner image surface after the fixation of the toner image using the film-like member is approximately the same as T2.

Examples of the fixation film-like member include endless films wherein a heat resistant film with a thickness of approximately 10 to 35 μm, and preferably of approximately 15 to 30 μm, such as poly(ethylene terephthalate), polyimide, or polyether imide is coated with approximately 10 to 30 μm of a release layer of fluoro resins such as polytetrafluoroethylenes, tetrafluoroethylene-perfluorovinyl ether copolymers, and tetrafluoroethylene-hexafluoropropylene copolymers to which a conductive material has been added. Examples of the conductive materials include metals and metal oxides in various states such as flaky, fibrous, and powder states; inorganic compounds such as graphite, carbon black, and aluminum; and conductive polymers represented by polyaniline; however, they are not limited to these examples.

Generally, the total thickness of the film-like member is approximately 30 μm to 100 μm and preferably 30 μm to 80 μm.

The film-like member is driven and transported following the driving of a driving roller and a driven roller. The transportation speed of the film-like member, that is the fixation linear speed, is preferably approximately 50 to 360 mm/sec and more preferably approximately 50 to 300 mm/sec.

A pressure roller, which is the pressurizing member installed facing the heating body via a film-like member, and which is press-contacted with the heating body and rotated so as to attach the transfer body to the heating body with pressure, has a rubber elastic layer of silicon rubber or the like with good release property. The total pressure between the pressure roller and the heating body is preferably approximately 10 to 36 kg and more preferably approximately 15 to 33 kg and the pressure roller applies pressure to the heating body through the film-like member and rotates while press-contacting.

In the color image formation method of the invention, a charging step for charging the photoconductor, an exposure step for exposing the charged photoconductor and forming the latent image, a development step for developing the latent image with a developer containing a color toner and forming a toner image on the photoconductor, and a transfer step for transferring the toner image onto paper via an intermediate transfer body and forming an un-fixed transfer image may be carried out properly by conventionally known methods and the components and apparatuses such as the photoconductor, the exposure apparatus, the development apparatus, and the intermediate transfer body to be used for these steps may be those which have conventionally been employed. Further, the image formation method of the invention may also comprise steps other than the above-mentioned steps such as a cleaning step for cleaning the surface of the latent image carrier.

Formation of an image by the image formation method of the invention can be carried out, for example, in the following manner.

At first, the surface of the electrophotographic photoconductor is evenly charged by a corotron charger, a contact charger, or the like and then exposed to form an electrostatic latent image. Next, toner particles are attached to the electrostatic latent image to form a toner image on the electrophotographic photoconductor by bringing a development roll with a developer layer formed on the surface into contact with or close to the photoconductor. The formed toner image is transferred to an intermediate transfer body surface in a primary transfer part using a corotron charger. Then, the toner image transferred to the intermediate transfer body surface is transferred to an image transfer body such as paper. Then, the above-mentioned fixation step is carried out to form an image on the image transfer body.

Next, the color toner used in the color image forming method of the invention is explained below.

The color toner according to the invention includes, as binder resins, at least one kind of crystalline resin and at least one kind of non-crystalline resin, wherein, in the dynamic viscoelasticity measurement due to a sine wave vibration method, a minimum value of the relaxation elasticity H in a relaxation spectrum obtained from a frequency dispersion characteristics measured at 60 and 80° C. with a measurement frequency set in the range of about 0.1 to 100 rad/sec provided that a measurement strain of about 6.28% is 0.1% is in the range of about 10 to 900 Pa/cm$^2$ and a relaxation time $\lambda$ corresponding to the minimum value is in the range of 1 to 10,000 sec.

The gloss of the fixation image is considerably affected by the dynamic viscoelasticity property of the toner. That is, it is dominated by the balance between the speed of the change of the fixed toner from the melted state (viscosity-dominant state) to the solid state (elasticity-dominant state), the leveling property at the time of melting, and the controllability of bleeding of the toner in the image transfer body such as paper.

As described above, the behavior of the toner at the time of fixation is due to deformation of the toner particles in the fixation system and the stress relaxation phenomenon, so that the gloss after the fixation can be controlled by controlling the stress molding behavior of the toner in relation to the temperature.

In the invention, it is found that when the dynamic viscoelasticity measurement by a sine wave vibration method is carried out, as conditions, with a measurement strain set at a frequency of 6.28 rad/sec being 0.1%, and each of a minimum value of the relaxation elasticity H in a relaxation spectrum obtained from a frequency dispersion characteristics measured at 60 and 80° C. with a measurement frequency set in the range of about 0.1 to 100 rad/sec and a relaxation time $\lambda$ corresponding to the minimum value is set in a definite range, the stress generated during the fixing can be controlled and thereby the roughness in an image surface due to the stress relaxation of the toner can be reduced.

The behavior of the toner at the fixing can be described as a sum of an elastic deformation and a viscous deformation. When it is assumed that the elasticity is Hookian one and the viscosity is Newtonian one, that is, the elasticity and the viscosity coefficient do not change with time, a viscoelastic deformation (shear velocity) can be expressed with the following Equation (1) below.

$$d\epsilon/dt=1/G\times d\sigma\cdot dt+\sigma/\eta \qquad \text{Equation (1)}$$

($\epsilon$: shear strain, $\sigma$: shearing stress, G: shear elasticity, $\eta$: viscosity, and t: time)

Here, when the deformation $\epsilon$ is assumed not to change with time, the stress can be expressed with the following Equation (2).

$$\sigma=\sigma_0 \exp(-t/\tau) \qquad \text{Equation (2)}$$

($\sigma_0$: stress when t=0, t=time, and $\tau$: relaxation time (=$\eta$/G)

That is, $d\epsilon/dt=0$ means that a time change when the rigorousness of a thermal movement having one freedom comes to an equilibrium value owing to the strain is expressed with $\sigma_0\exp(-t/\tau)$. Accordingly, the stress a decreases with time. This is defined as a relaxation. Specifically, it is a reduction rate at $t=\tau$, and $\sigma/\sigma_0$ becomes 1/e (e is natural logarithm) and expresses a time until the stress $\sigma$ becomes 1/e, that is, 0.3679 times; accordingly, it can express a speed of the relaxation.

In general, the stress relaxation of the toner as a whole at the fixing is a sum total of relaxations due to various small flow deformations inside of the toner. Since the inside of actual toner is not homogeneous but a composite, the relaxations become important. Furthermore, the foregoing relaxation is generally expressed with a multi-element model and relationship between stress and strain at this time can be expressed with the following Equation (3).

$$\sigma/\epsilon_0=G(t)=\Sigma Gi\cdot \exp(-t/\tau i) \qquad \text{Equation (3)}$$

The G(t) is the relaxation elasticity H, that expresses the elasticity for each minute time of the toner deformation and varies with time. Accordingly, even in case of the same toner, when rapidly deformed, it exhibits the elasticity, when deformed slowly, it exhibits the viscosity, and, in an intermediate region, it exhibits the viscoelasticity. A time necessary for the deformation is defined as a timescale (measurement time), and this affects on the mechanical property of the toner.

Furthermore, when the relaxation time $\tau$ is smaller, the G becomes larger, and, at a certain time t, since the relaxations occur according to the respective $\tau$, when the relaxation time is applied in place of the deformation time, G(t) can be expressed with the following Equation (4).

$$G(t)=\int G(\tau)\cdot \exp(-t/\tau)d\tau \qquad \text{Equation (4)}$$

The G(t) in this formula is gene-rally called as a relaxation spectrum.

Furthermore, in general, the toner is mainly made of a polymer; accordingly, the relaxation spectrum includes a wedge portion and a box portion. It is known that in the wedge portion, the relaxation of a side chain of a polymer appears, and inside of the wedge portion, fluidization relaxation due to micro-Brownian movement of a segment mainly appears; and in the box portion, the fluidization relaxation due to the macro-Brownian movement of the segment appears. That is, as a magnitude of a portion that moves becomes larger, the relaxation time becomes longer and the elasticity to which the larger portion contributes decreases; on the contrary, as a moving portion becomes smaller, the involving elasticity becomes larger.

As will be described below, when the frequency dispersion characteristics of the storage elasticity of the toner at a fixed temperature is measured to obtain the relaxation spectrum therefrom, a minimum value of the relaxation elasticity H is present between the wedge portion (elasticity predominant region) and the box portion (viscosity predominant region); accordingly, when a value of the relaxation elasticity H at the minimum value and the relaxation time λ that shows the minimum value each are set in a definite range, the balance between the elasticity and the viscosity of the toner at the fixing, that is, a time of stress relaxation to the deformation can be controlled.

The present inventors have found a range of the minimum value of the relaxation elasticity H in which the roughening of the gloss owing to the deformation of the image after fixation and bleeding property in the paper are suppressed to maintain a high gloss and a range of the relaxation time λ corresponding thereto and have conducted structural control of the toner to satisfy these properties and accordingly have accomplished the invention. In the fixation method for carrying out thermal fixation through the film-like member, although the local temperature difference in the fixation member is improved, the improvement is not sufficient and a problem of hot offset becomes considerably apparent especially at the time of use of a high gloss toner. Therefore, the time of stress relaxation corresponding to the deformation is controlled to be within the above-mentioned range by keeping the balance between the toner elasticity and the viscosity and the thermal fixation is carried out using such a toner through the film-like member, so that the likelihood of hot offset can be reduced in the image formation required to give high gloss or in oil-less fixation.

As described above, in the invention the minimum value of the relaxation elasticity H in the relaxation spectrum is required to be within a range of approximately 10 to 900 $Pa/cm^2$, and the relaxation time λ corresponding to the minimum value is required to be in a range of approximately 10 to 10,000 seconds.

If the minimum value of the relaxation elasticity H is lower than approximately 10 $Pa/cm^2$, although the warp of the paper is lowered at the time of both-side printing using thin paper, the unevenness in the toner in the binder resin becomes significant and the strain responsiveness is deteriorated and sufficient fixation strength cannot be obtained.

On the other hand, if the minimum value of the relaxation elasticity H is higher than approximately 900 $Pa/cm^2$, the shrinkage becomes significant owing to the stress relaxation of the fixed toner and in the case the process speed exceeds 300 mm/sec and thin paper is used, this tendency becomes more pronounced.

When the relaxation time λ corresponding to the minimum value of the relaxation elasticity H is shorter than approximately 1 second, although the stress generation is lowered at the time of fixation for the high molecular weigh substance such as the toner, the toner rigidity becomes high to deteriorate the fixation property at a low temperature.

On the other hand, if it is longer than approximately 10,000 seconds, the warp following the image shrinkage becomes significant and-the unevenness of the toner binder resin is increased and thus fixed image strength cannot be obtained.

The minimum value of the relaxation elasticity H is preferably in a range of approximately 10 to 900 $Pa/cm^2$ and more preferably in a range of approximately 50 to 900 $Pa/cm^2$. The corresponding relaxation time λ is preferably in a range of approximately 10 to 10000 seconds and more preferably in a range of approximately 10 to 9000 seconds.

The relaxation spectrum in the invention can be calculated from the frequency dispersion characteristic measured at approximately 60° C. and 80° C. by setting the measurement frequency to approximately 0.1 to 100 rad/sec, and the measurement strain to 0.1% at frequency 6.28 rad/sec in dynamic viscoelasticity measurement by sinusoidal vibration method.

For the dynamic viscoelasticity measurement, frequency dispersion of the dynamic viscoelasticity measurement by the sinusoidal vibration method is preferably employed. In the frequency dispersion, 60° C., at which the toner is in the transition range from the glass state and both the fixation and the heat preservation property of the toner are affected, is preferably employed as the measurement temperature. While depending on the rigidity of the resin, the strain at the time of measurement is set to be 0.1% in this invention.

The relaxation spectrum can be calculated by mathematical conversion to the relaxation elasticity and relaxation time by producing an overlapped curve (a master curve) from the frequency dispersion properties of the storage elasticity at approximately 60° C. and approximately 80° C. according to the well-known temperature-time conversion rule.

Hereinafter, the measurement of the relaxation modulus spectrum in the invention will be described in more detail.

In the beginning, the frequency dispersion of the storage elasticity in the invention is obtained according to the following procedure.

An ARES System (trade name, manufactured by Texas Instrument Corp.) is used as a measurement device. A toner that is being subjected to measurement is press-molded under a normal temperature so as to be in a shape of tablets having a thickness of 2.2 mm. A parallel plate having a diameter of 25 mm is prepared on a measurement jig of the and a zero point adjustment is applied thereto. The prepared tablets are set on a measurement jig of the measurement device. Subsequently, a temperature of the measurement jig is adjusted to 95° C. to heat for 5 min so that the sample tablet and the measurement jig are well contacted. Furthermore, the thickness is adjusted to 2.0 mm, followed by cooling to a temperature of 60° C. at a temperature lowering speed of 1° C./min.

After a temperature is reached to 60° C., the temperature of the sample is maintained for 5 minutes. Then, the strain rate is controlled so as to be 0.1% at a frequency of 6.28 rad/sec, and the respective storage elasticity at that time are obtained, and the frequency dispersion characteristics of the storage elasticity is obtained.

Furthermore, another measurement is carried out in the same manner as described above, except that the temperature of 60° C. is changed to 80° C.

In the next place, obtained frequency characteristic curves of the storage elasticity at temperatures 60° C. and 80° C. are convoluted based on a principle of convolution to prepare a master curve. At this time, the curve at 60° C. is set as a reference. Then, according to the foregoing method, the master curve is converted into a relaxation spectrum. The analysis of the relaxation spectrum is conducted by using a software attached to the ARES system (described above).

The relaxation spectrum is obtained as relationship between a relaxation time λ on a horizontal axis and a relaxation elasticity H on a vertical axis. From a minimum point that appears in the middle of decrease of the relaxation elasticity from low relaxation times to high relaxation times of the relaxation spectrum, the minimum value of the relaxation elasticity H and the relaxation time corresponding thereto are obtained.

Furthermore, in general, the frequency in the dynamic viscoelasticity is known to correspond to the speed. From this, in the invention as well, it is found that by controlling the frequency dispersion characteristics of the storage elasticity, the reduction of the dependence on the process speed (fixing speed) of the fixing property can be achieved while maintaining the low temperature fixing property and high glossiness of images.

Further, the storage elasticity H in the frequency dispersion characteristics measured at 60° C. with the measurement frequency set in the range of about 0.1 to 100 rad/sec with a measurement strain set at a frequency of 6.28 rad/sec being 0.1% corresponds to the hardness of the toner in a transition region from a glass state in each of the process speeds. Accordingly, when a gradient K of the frequency dispersion curve is set in a definite range, the low temperature fixing property and the decrease of the dependence on the process speed can be optimized.

In the invention, the gradient K is preferably set in the range of about 0.12 to 0.87 $Pa/cm^{2\cdot}$° C., and more preferably in the range of about 0.15 to 0.8 $Pa/cm^{2\cdot}$° C. When the gradient K is smaller than about 0.12 Pa/ $cm^{2\cdot}$° C., the dependence on the process speed of a machine of the fixing property becomes smaller; however, since the non-uniformity inside of the toner binder resin is large and the responsiveness of the strain becomes lower, in some cases, sufficient fixing strength cannot be obtained. Furthermore, when the gradient K is larger than about 0.87 $Pa/cm^{2\cdot}$° C., the machine process dependence of the fixing property becomes large, in particular when the process speed exceeds about 300 mm/sec, the hardness of the toner at the fixing becomes larger; as a result, sufficient fixing property cannot be obtained and the cold offset may result in some cases.

The gradient K, in the frequency dispersion curve of the storage elasticity at the 60° C., is obtained as a change gradient of the respective storage elasticity corresponding to the frequencies 0.1 and 100 rad/sec.

Accordingly, a toner, that satisfies the condition involving the minimum value of the relaxation spectrum and further the condition of the gradient in the foregoing frequency curve, is excellent in the blocking resistance, can obtain a low temperature fixing property and a high glossiness, and can largely reduce a change of fixing temperature latitude which maintains the high glossiness.

In the image formation method in the invention, it is important that the physical properties of the color toner are kept in the above-mentioned ranges according to the dynamic viscoelasticity measurement by the sinusoidal vibration method. That is, the invention makes it clear that it is very advantageous for the physical properties of the color toner to be kept in the above-mentioned ranges according to the dynamic viscoelasticity measurement by the sinusoidal vibration method.

The method for adjusting such physical properties of the color toner to within these ranges is not particularly limited and it can be achieved by properly selecting the types of binder resins (including crystalline resins and non-crystalline resins), melting points of the crystalline resins, glass transition temperature (Tg) and softening point of the non-crystalline resins, the mixing ratio of the crystalline resins and non-crystalline resins, the toner production method, and combinations thereof. As long as the properties are within the ranges, the composition of the toner is not particularly limited, except that at least one kind of each the crystalline resins and the non-crystalline resins is contained in the binder resin. Hereinafter, the toner composition will be described more in detail.

A binder resin used in the invention contains at least one kind of crystalline resin and at least one kind of non-crystalline resin. In the invention, the "binder resin" means a resin that becomes a main component in an ordinary toner particle (matrix particle). However, for instance, in a core-shell type toner particle described later, the "binder resin" means a resin including not only a core but also a shell.

The "crystalline resin" in the invention indicates one that in a differential scanning calorimetry (DSC) shows not a stepwise change in a heat absorption amount but a clear heat absorption peak.

The crystalline resin, is not particularly restricted as far as it has a crystallinity. Specific examples thereof include a crystalline polyester resin, a crystalline vinyl-base resin and the like. From viewpoints of the fixing property to paper at the fixing, the fixing property and the melting point adjustment in a preferable range, the crystalline polyester resin is preferable. Furthermore, a straight-chain fatty acid crystalline polyester resin having an appropriate melting point is more preferable.

The crystalline polyester resin is synthesized from an acid (dicarboxylic acid) component and an alcohol (diol) component. In the invention, a copolymer in which, to a crystalline polyester resin main chain, other component is copolymerized at a ratio of 50% by mass or less, is also included in the scope of the crystalline polyester resin.

A manufacturing method of the crystalline polyester resin is not particularly restricted. A general polyester polymerizing method in which an acid component and an alcohol component are allowed to react can be used. Examples thereof include a direct polycondensation method, an ester exchange method and the like. These manufacturing methods can be appropriately selected depending on the kind of monomers.

The crystalline polyester resin can be manufactured at a polymerization temperature in the range of about 180 to 230° C., and, as needs arise, a reaction system is depressurized to allow reacting while removing water and alcohol generated during condensing. When a monomer is not dissolved or miscible under a reaction temperature, a high boiling point solvent may be added as a solubilizing agent so as to dissolve the monomer. The polycondensation reaction is carried out while distilling the solubilizing agent. When a monomer having less compatibility is present in the copolymerization reaction, the monomer and an acid or alcohol that is being reacted with the monomer may be condensed in advance, followed by polycondensating with a main component.

Examples of the catalysts that can be used when the crystalline polyester resin is manufactured include compounds of alkali metal such as sodium and lithium; compounds of alkaline earth metals such as magnesium or calcium; compounds of metals such as zinc, manganese, antimony, titanium, tin, zirconium or germanium; and phosphites, phosphates and amine compounds.

Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris (2,4-t-butylphenyl) phosphite, ethyltriphenyl phosphonium bromide, triethylamine, triphenylamine or the like.

On the other hand, examples of the crystalline vinyl resins include vinyl resins that use, as a monomer, (meth) acrylic acid ester of long chain alkyl or alkenyl (meth)acrylic acid ester such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, or behenyl (meth)acrylate. In the present specification, the expression of "(meth) acryl" means that both "acryl" and "methacryl" are included in the scope thereof.

The melting point of the crystalline resin in the invention is preferably in the range of about 50 to 120° C., and more preferably in the range of about 60 to 110° C. When the melting point is lower than about 50° C., problems may arise in some cases in the storage stability of the toner and the storage stability of the toner image after fixing. On the other hand, when the melting point is higher than about 120° C., in some cases, sufficient low-temperature fixing cannot be obtained when compared with conventional toners.

The melting point of the crystalline resin can be measured by use of a differential scanning calorimeter (trade name: DSC-7, manufactured by Perkin-Elmer Corp.). In the calorimeter, a temperature compensation of a detector is applied with melting points of indium and zinc, and an amount of heat is compensated with a heat of fusion of indium. When a sample, with an aluminum pan and with a vacant pan set as a reference, is measured at a temperature rising speed of 10° C./min from room temperature to 150° C., the melting point of the crystalline resin can be obtained as a melting peak temperature of differential scanning calorimetry shown in ASTM D3418-8. In addition, in some cases, the crystalline resin exhibits a plurality of melting peaks; however, in the invention, the maximum peak is regarded as the melting point.

The crystalline resin in the binder resin may be used alone or in combination of two or more thereof.

The "non-crystalline resin" in the invention is one that, in the foregoing DSC, does not exhibit a clear absorption peak but a step-wise absorption change.

Conventionally-known resin materials can be used as the non-crystalline resin in the invention. Among them, a non-crystalline polyester resin is particularly preferable.

The non-crystalline resin is mainly obtained by condensation polymerization of polyvalent carboxylic acids and polyvalent alcohols.

Examples of the polyvalent carboxylic acids that are used to prepare the non-crystalline polyester resin in the invention include an aromatic dicarboxylic acid such as terephthalic acid, isophthalic acid, orthophthalic acid, 1,5-naphthalene dicarboxylic acid, 2,6-naphthalene dicarboxylic acid or diphenic acid; an aromatic oxycarboxylic acid such as p-oxybenzoic acid or p-(hydroxyethoxy) benzoic acid; an aliphatic dicarboxylic acid such as succinic acid, alkylsuccinic acid, alkenylsuccinic acid, adipic acid, azelaic acid, sebacic acid, or dodecane dicarboxylic acid; and an unsaturated aliphatic and an alicyclic dicarboxylic acid such as fumaric acid, maleic acid, itaconic acid, mesaconic acid, citraconic acid, hexahydrophthalic acid, tetrahydrophthalic acid, dimer acid, trimer acid, hydrogenated dimer acid, cyclohexane dicarboxylic acid, or cyclohexene dicarboxylic acid. Examples of the polyvalent carboxylic acids further include a tri- or more-valent carboxylic acid such as trimellitic acid, trimethic acid or pyromellitic acid.

In the invention, polyvalent carboxylic acids containing approximately 5% by mole or more of cyclohexane dicarboxylic acid are preferably used, and furthermore an content of cyclohexane dicarboxylic acid used is preferably in a range of approximately 10 to 70% by mole of the polyvalent carboxylic acid, more preferably in a range of approximately 15 to 50% by mole, and particularly preferably in a range of approximately 20 to 40% by mole. Furthermore, as the cyclohexane dicarboxylic acid, at least one kind of 1,4-cyclohexane dicarboxylic acid, 1,3-cyclohexane dicarboxylic acid and 1,2-cyclohexane dicarboxylic acid can be used. Still furthermore, one in which hydrogen atoms of a cyclohexane ring are partially substituted by an alkyl group or the like may be used in combination. When the content of the cyclohexane dicarboxylic acid is less than the foregoing range, the fixing property is not exhibited, and when the content of the cyclohexane dicarboxylic acid exceeds the foregoing range, a unit price of the resin goes up and a problem in view of cost may be caused.

Examples of the polyhydric alcohols that is used to manufacture the non-crystalline polyester resin include aliphatic polyhydric alcohols, alicyclic polyhydric alcohols, and aromatic polyhydric alcohols. Examples of the aliphatic polyhydric alcohols include aliphatic diols such as ethylene glycol, propylene glycol, 1,3-propane diol, 2,3-buthane diol, 1,4-buthane diol, 1,5-pentane diol, 1,6-hexane diol, neopentyl glycol, diethylene glycol, dipropylene glycol, dimethylol heptane, 2,2,4-trimethyl-1,3-pentane diol, polyethylene glycol, polypropylene glycol, polytetramethylene glycol, or lactone polyester polyol that is obtained by applying ring-opening polymerization to lactone such as □-caprolactone, and triols and tetraols such as trimethylol ethane, trimethylol propane, glycerin, or pentaerythritol.

Examples of the foregoing alicyclic polyhydric alcohols include 1,4-cyclohexane diol, 1,4-cyclohexane dimethanol, spiroglycol, hydrogenated bisphenol A, ethylene oxide adduct and propylene oxide adduct of hydrogenated bisphenol A, tricyclodecane diol, tricyclodecane dimethanol, dimer diol and hydrogenated dimer diol.

Examples of the aromatic polyhydric alcohols include p-xylene glycol, m-xylene glycol, o-xylene glycol, 1,4-phenylene glycol, ethylene oxide adduct of 1,4-phenylene glycol, bisphenol A, ethylene oxide adduct of bisphenol A and propylene oxide adduct of bisphenol A and the like.

Furthermore, in order to improve a stability of the toner charging property against environmental changes, a polar group at a terminal of a polyester molecule is blocked and a mono-functional monomer is introduced in the polyester resin in some cases. Examples of the mono-functional monomer include mono-carboxylic acids such as benzoic acid, chlorobenzoic acid, bromobenzoic acid, p-hydroxybenzoic acid, mono-ammonium sulfobenzoate, mono-sodium sulfobenzoate, cyclohexylaminocarbonylbenzoic acid, n-dodecylaminocarbonylbenzoic acid, tertiary-butylbenzoic acid, naphthalene carboxylic acid, 4-methylbenzoic acid, 3-methylbenzoic acid, salicylic acid, thiosalycilic acid, phenylacetic acid, acetic acid, propionic acid, lactic acid, iso-lactic acid, octane carboxylic acid, lauric acid, stearic acid, or low alkyl esters thereof, and mono-alcohols such as aliphatic alcohols, aromatic alcohols, or alicyclic alcohols.

Furthermore, styrene-acryl compound resins can be used as the known non-crystalline resins. Specific examples thereof include polymers of monomers such as styrenes such as styrene, p-chlorostyrene or α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; vinyl nitriles such as acrylonitrile or methacrylonitrile; vinyl ethers such as vinyl methyl ether or vinyl isobutyl ether; vinyl ketones such as vinyl methyl ketone, vinyl ethyl ketone, or vinyl isopropenyl ketone; or polyolefins such as ethylene, propylene, or buthadiene: copolymers or mixtures obtained by combining at least two kinds thereof: non-vinyl resins such as an epoxy resin, a polyester resin, a polyurethane resin, a polyamide resin, a cellulose resin or a polyether resin: or mixtures of these and the foregoing vinyl resins: and graft polymers obtained when vinyl monomers are polymerized under co-existence of these.

The glass transition temperature of the non-crystalline resin used in the invention is required to be about 40° C. or more, preferably about 45° C. or more, and more preferably about 50° C. or more, and further preferably about 50° C. or more and less than about 90° C. When the glass transition temperature is less than about 40° C., the toner tends to flocculate during handling or storage, which may cause a problem of the storage stability. Further, since the toner contracts largely, curling tendency of sheet when double-side printing is applied thereto becomes larger. Furthermore, the glass transition temperature is about 90° C. or more, the fixing property is unfavorably deteriorated.

The softening point of the non-crystalline resin that is used in the invention is preferably in a range of about 60 to 90° C. A toner, of which softening point is set lower than this range, tends to flocculate during handling or storage. In particular, when it is stored long, the fluidity may be largely deteriorated in some cases. When the softening point is higher than this range, a fixing property thereof may be damaged. Furthermore, since a fixing roll has to be heated at a higher temperature for using such toner, a material of the fixing roll and a material of a base material on which a copy is made are restricted.

The "softening point" herein used is a temperature when a melt viscosity that is measured with a flow tester (trade name: CFT-500, manufactured by Shimadzu Corporation) with a nozzle having a diameter of 1 mm and a thickness of 1 mm under load of about 10 kgf (98N) becomes about 104 Pa·s (105 poise).

The non-crystalline resin in the binder resin may be used alone or in combination of two or more kinds thereof.

In the invention, at least one kind of the crystalline resin and at least one kind of the non-crystalline resin are necessarily contained as the binder resin. Accordingly, the crystalline resin and the non-crystalline resin are preferably simultaneously blended and used when toner particles are manufactured. As mentioned above, since the "binder resin" in the invention includes a shell in the core-shell structure, a structure of the binder resin may be, for example, that in which a core contains the crystalline resin and a shell contains the non-crystalline resin.

The crystalline resin is preferably contained in a range of about 5 to 70% by mass and more preferably in a range of about 10 to 50% by mass relative to components that constitute the binder resin. When a ratio of the crystalline resin exceeds about 70% by mass, excellent fixing property can be obtained and the dependence on the process speed of the fixing property can be assuredly reduced. However, since the characteristics of the crystalline resin become dominant, a phase separation structure in a fixed image may become irregular, the mechanical strength of the fixed image, in particular, the scratch resistance may be deteriorated, and the bruise tends to occur.

On the other hand, when the ratio of the crystalline resin is less than about 5% by mass, in some cases, a sharp-melt property derived from the crystalline resin may not be obtained and a plasticity may simply occur; accordingly, in some cases, the toner blocking resistance and the image storage stability may not be maintained while attaining with excellent low temperature fixing property maintaining. Furthermore, since the frequency dependence of the storage elasticity of the toner, that is, the fixing speed dependence may become larger, when the fixing speed is large, the fixing property may deteriorate.

A ratio of the crystalline resin to the non-crystalline resin (the crystalline resin/the non-crystalline resin) is preferably in a range of about 5/95 to 70/30 by mass ratio because this enables to satisfy the dynamic viscoelastic characteristics, and particularly preferably in a range of about 10/90 to 50/50.

As the releasing agent that is used in the invention, a substance that has a peak temperature of the maximum endothermic-peak measured in accordance with ASTM D3418-8 in a range of about 50 to 110° C. is preferable. When the peak temperature is less than about 50° C., in some cases, offsets tend to occur. at during fixing. Furthermore, when it exceeds about 110° C., not only the viscosity of the releasing agent becomes higher and the fixing temperature becomes higher, but also in some cases the eluting property of the releasing agent during oil-less fixing decreases to damage the stripping property.

The peak temperature of the maximum absorption peak is obtained as a peak position temperature of the maximum peak of at least one or more absorption peaks measured by carrying out the similar DSC measurement as that in which the DSC-7 (described above) is used to measure the releasing agent.

Examples of the releasing agent include low molecular weight polyolefins such as polyethylene, polypropylene, or polybutene; silicones having a softening point owing to heating; fatty acid amides such as oleic acid amide, erucic acid amide, ricinolic acid amide, or stearic acid amide; plant waxes such as carnauba wax, rice wax, chandellila wax, Japan tallow, or jojoba wax; animal wax such as bees wax; and mineral waxes or petroleum waxes such as montanic acid ester wax, ozokerite, ceresin, paraffin wax, microcrystalline wax, or Fischer-Tropsch wax, and furthermore modified ones thereof also can be used.

An amount of the releasing agent that is added is preferably in a range of about 5 to 25 parts by mass to 100 parts by mass of the binder resin, and more preferably in a range of about 7 to 20 parts by mass.

As a colorant in a toner according to the invention, conventionally-known colorants can be used.

Examples of black pigments include carbon black, copper oxide, manganese dioxide, aniline black, activated carbon, non-magnetic ferrite, magnetite and the like.

Examples of yellow pigments include chrome yellow, zinc yellow, yellow iron oxide, cadmium yellow, Hansa yellow, Hansa Yellow 10G, benzidine yellow G, benzidine yellow GR, threne yellow, quinoline yellow, permanent yellow NCG and the like.

Examples of orange pigments include red chrome yellow, molybdenum orange, permanent orange GTR, pyrazolone orange, Vulcan orange, benzidine orange G, indanthrene brilliant orange RK, indanthrene brilliant orange GK and the like.

Examples of red pigments include iron oxide red, cadmium red, red lead, mercury sulfide, Watchang red, permanent red 4R, lithol red, brilliant carmine 3B, brilliant carmine 6B, DuPont™ oil red, pyrazolone red, rhodamine lake B, lake red C, rose Bengal, eosin red, alizarin lake and the like.

Examples of blue pigments include iron blue, cobalt blue, alkali blue lake, Victoria blue lake, fast sky blue, indanthrene blue BC, aniline blue, ultramarine blue, chalcoil blue, methylene blue chloride, phthalocyanine blue, phthalocyanine green, malachite green oxalate and the like.

Examples of purple pigments include manganese purple, fast violet B, methyl violet lake and the like.

Examples of green pigments include chromium oxide, chrome green, pigment green, malachite green lake, final yellow green G and the like.

Examples of white pigments include zinc oxide, titanium oxide, antimony white, zinc sulfide and the like.

Examples of extender pigments include barytes, barium carbonate, clay, silica, white carbon, talc, alumina white and the like.

Furthermore, Examples of dyes include various kinds of dyes such as basic, acidic, dispersion and direct dyes, for instance, nigrosin and the like. A mixture thereof and one in a solid solution state can be also used.

The foregoing colorant is selected from viewpoints of the hue, color saturation, luminosity, weather resistance, OHP transmittance and dispersing property in the toner. An amount of the colorant that is added is in a range of about 1 to 20 parts by mass relative to 100 parts by mass of the binder resin. When a magnetic material is used for the black colorant, different from other colorants, about 30 to 100 parts by mass thereof relative to 100 parts by mass of the binder resin are added.

Furthermore, when the toner is used as a magnetic material, magnetic powder may be contained. Examples of such magnetic powder include a substance that is magnetized in a magnetic field. Specific examples thereof include ferromagnetic powder such as iron, cobalt or nickel, and compounds such as ferrite or magnetite. In particular, when toner particles are obtained in an aqueous layer, the aqueous layer transferability, solubility and oxidizing property of the magnetic material have to be taken into consideration. Preferably, surface modification such as hydrophobidization can be applied to the magnetic material in advance.

In the invention, in order to further improve and stabilize the charging property, a charge control agent can be used in the toner. Examples of the charge control agent include various kinds of charge control agents that are ordinarily used such as quaternary ammonium salt compounds, nigrosin compound, dyes made of aluminum, iron or chromium complex or triphenyl methane pigment. From viewpoints of controlling the ionic strength that affects on the stability during flocculation and unification in an emulsifying polymerization described below and reduction of the waste water contamination, a material which hardly dissolve in water is preferable.

Furthermore, in the invention, in order to improve the stability of the charging property and the fluidity, inorganic particles can be added on a surface of the toner. Examples of inorganic particles that can be added include particles of silica, alumina, titanium oxide, barium titanate, magnesium titanate, calcium titanate, strontium titanate, zinc oxide, quartz sand, clay, mica, wollastonite, diatom earth, cerium chloride, red iron oxide, chromium oxide, cerium oxide, antimony trioxide, magnesium oxide, zirconium oxide, silicon carbide, silicon nitride and so on. Among these, silica particles are preferable and hydrophobidized silica particles are particularly preferable.

An average primary particle diameter (number-average particle diameter) of the inorganic particles is preferably in a range of about 5 to 1,000 nm and an amount thereof that is added (external addition) is preferably in a range of about 0.01 to 20 parts by mass relative to 100 parts by mass of the toner. The primary particle diameter measurement is carried out by taking a photograph by a scanning electron microscope in a manner that the maximum length of the inorganic particles is within 1 mm to 5 mm and the length is directly measured. The number of the particles to be measured is 100 and the average value of the measurement results is defined as the average primary particle diameter (number average particle diameter).

When toner particles are processed in a wet method described later, one which can be used as an external additive can be used by dispersing with an ionic surfactant, a polymer acid or a polymer base to use.

Furthermore, particles of a resin such as a vinyl resin, polyester, silicone, polystyrene, polymethyl methacrylate or polyvinylidene fluoride can be used as a fluidity additive or cleaning additive by being added onto a toner surface in a dry state under shear condition.

The color toner particles according to the invention preferably have a core/shell structure, which can be observed in a section observation using a transmission electron microscope (TEM) as a whole. Specifically, as mentioned above, the toner particles according to the invention contain a crystalline resin as the binder resin; accordingly, a shell is preferably formed with the non-crystalline resin so as to prevent an exposure of the internal crystalline resin and deterioration of the fluidity and charging property of the toner which accompany with the exposure.

When the core/shell structure cannot be observed in the toner particles, the crystalline resin, releasing agent, and colorant may, in some cases, be exposed to damage the charging property and the powder characteristics of the toner particles, even though the fixing property of the toner particles becomes excellent.

In the above, the "core/shell structure" means a structure observed in a photograph of a toner section in which a shell (outer shell) having a thickness in a range of about 0.1 to 0.8 μm is formed in a periphery of the core (internal matrix particle) so as to cover about 80% or more of the core.

The TEM observation is carried out as follows. In the beginning, as a wrapping process of the toner, 7 g of bisphenol A type liquid epoxy resin (manufactured by Asahi Chemical Industry Co., Ltd.) and 3 g of a hardener (trade name: ZENAMID 250, manufactured by Henkel Japan Ltd.) are mildly mixed and prepared, followed by mixing 1 g of toner and leaving to harden, and thereby a grinding sample is prepared. Subsequently, with a grinder LEICA ultra-microtome (model number: ULTRACUT UCT, manufactured by Hitachi High Technologies Corp.) provided with a diamond knife (trade name: TYPE CRYO, manufactured by DIATOME Corp.), a wrapped sample for grinding is ground under −100° C. to prepare an observation sample.

Furthermore, the foregoing sample is left in a desiccator under a ruthenium tetraoxide (manufactured by Soekawa Chemical Co., Ltd.) atmosphere to dye. A degree of dying is judged by visually observing a degree of dying of a simultaneously left tape. A section of the dyed sample toner is observed by using a high-resolution field emission scanning electron microscope (trade name: S-4800, manufactured by Hitachi High Technologies Co., Ltd.) provided with a transmitted electron detector. At this time, an observation multiplication factor is set at 5,000 and 10,000 times.

In the foregoing TEM observation, it is preferable that, inside of the toner, the crystalline resin crystals and the releasing agent crystals coexist in a form that the crystalline resin crystals and the releasing agent crystals are included as an island structure and the non-crystalline resin is included as a sea structure; a shape of the crystalline resin crystals is block-shaped; and a wetted perimeter of the releasing agent crystals is in a range of about 0.5 to 1.5 μm.

In the above, "the crystalline resin crystals and the releasing agent crystals coexist in a form that the crystalline resin crystals and the releasing agent crystals are included as an island structure and the non-crystalline resin is included as a sea structure" means that at least an island structure of crystals (crystalline resin crystals) based on the crystalline resin and an island structure of crystals (releasing agent crystals) based on the releasing agent can be separately observed in a sea structure of the non-crystalline resin.

Furthermore, "the crystalline resin crystal is block-shaped" means that an aspect ratio of the crystalline resin crystals, that is defined by a shorter side length of the crystalline resin crystals relative to a longer side length of the crystalline resin crystals (shorter side/longer side), is in a range of about 0.6 to 1.0. Still furthermore, "rod-shaped" described later means that the aspect ratio is in a range of about 0.05 to 0.3. Still furthermore, "being block-shaped" means that about 10% or more of the observed crystalline resin crystals is block-shaped.

When the crystalline resin crystals are block-shaped, at the softening/melting of the toner ensuing the fixing/heating, the elution directivity of molten crystalline resin becomes excellent, and thereby the elution property to a fixed image surface is preferably improved.

Furthermore, a size (wetted perimeter) of the crystalline resin crystal is preferably in a range of about 0.5 to 1.5 μm. When the size is less than about 0.5 μm, only the compatibility with the non-crystalline resin is generated and the low temperature fixing property is surely improved. However, in some cases, an apparent Tg of the binder resin decreases and the powder characteristics and image storage stability deteriorate. On the other hand, when the size exceeds about 1.5 μm, surely it is advantageous in the oil-less stripping at a complete constant temperature; however, in a system having a large temperature distribution like a fixing process of an electrophotography, it is necessary to impart a certain fluctuation in the melting property. When the size exceeds about 1.5 μm, it may not be attained.

Still furthermore, a size (wetted perimeter) of the releasing agent crystals in the toner necessary for maintaining the foregoing stripping property is important and preferably in a range of about 0.5 to 1.5 μm. When it is less than about 0.5 μm, at the melting during the fixing, in some cases, uniform bleeding property cannot be obtained. On the other hand, when it exceeds about 1.5 μm, an un-molten portion is generated at the fixing, and thereby not only the bending resistance of a fixed image may be damaged and an image defect may be generated, but also in some cases the transparency at the OHP outputting may be unfavorably damaged.

In the TEM observation of a toner section, both of rod-shaped releasing agent crystal and block-shaped releasing agent crystal preferably present inside of the foregoing toner as the releasing agent crystal.

That is, when the shape of the releasing agent crystals present inside of the toner is only any one of rod-shaped and block-shaped, since a melting time period during the heating/fixing may become uniform, it is surely advantageous in the atripping of the oil-less fixing at a complete constant temperature. However, in a system having a large temperature distribution like a fixing process of an electrophotography, it is necessary to impart a certain fluctuation in the melting property. Accordingly, the coexistence of the rod-shaped crystals and the block-shaped crystals that are different in the melting property may become important for the stripping stability of the oil-less fixing.

The foregoing "wetted perimeter" in the invention means the maximum length when sizes of the crystalline resin crystals or releasing agent crystals are measured with a photograph obtained in the TEM observation and an average value of the length measured for approximately 100 of the toner particles.

Here, in general, a crystalline polymer that constitutes the releasing agent, normally from a state thereof, that is, moving states of molecular chains, as a temperature goes up, undergoes phase change such as a glass region, transition region, rubber-like region and fluidizing region. Among these changes of state, the glass region is a state where a temperature is equal to or lower than the glass transition temperature (Tg) and a movement of a main chain of a polymer is frozen. However, when the temperature goes up, the movement of molecules becomes larger and the melting of crystals results. This temperature is taken as a melting point. However, even after the melting, the viscosity varies depending on the molecular weight and the molecular structure; accordingly, together with the melting point, the characteristics are also important factor for understanding the characteristics of the releasing agent.

Furthermore, the viscosity of the releasing agent largely affects on the stripping property in the fixing in an electrophotography of the oil-less toner. That is, when the toner is heated and melted in the fixing, the releasing agent present in the toner is melted and eluted to form a film between a fixing member and a toner fixed layer and thereby to secure the stripping property between the fixing member and a sheet. Accordingly, the melt viscosity of the releasing agent is very important, since it affects on the readily eluting property. Furthermore, when the releasing agent is melted, a balance with the viscoelasticity of the binder resin is important. That is, since the viscosity (viscoelasticity) of the binder resin as well varies with a temperature and the higher the temperature, the more viscous property is exhibited, it is important to establish a balance between the viscosity of the releasing agent and the viscosity of the binder resin.

Furthermore, in the invention, in a toner surface observed from a scanning electron microscope (SEM) image, pores of 200 nm or less are observed and a ratio of the pores in a toner surface area is preferably less than 20%. When a size of the pore exceeds 200 nm, since a loss when an external additive is added is large, in some cases, the charging property/fluidity may be damaged. When the ratio exceeds 20%, uneven adhesion of the external additive may be caused to unfavorably damage the charging property.

In the SEM observation, a scanning electron microscope (trade name: S-4800 manufactured by Hitachi High Technologies Co., Ltd.) is used.

A volume average particle diameter of the toner particles of the toner according to the invention is preferably in a range of about 3 to 9 μm, and more preferably in a range of about 3 to 8 μm. When the volume average particle diameter of the toner particles exceeds about 9 μm, since a ratio of coarse particles becomes higher, the reproducibility of a thin line and a fine dot of an image obtained through the fixing and the gradation property may deteriorate. On the other hand, when the volume average particle diameter of the toner particles is less than about 3 μm, the powder fluidity, developing property or the transferring property of the toner may deteriorate, and various inconveniences in other processes ensuing the deterioration of the powder characteristics such as the deterioration of the cleaning property of the toners remaining on a surface of an image carrier may be caused.

Furthermore, as an index of a particle size distribution of the toner particles that are used in the invention, a volume average particle size distribution index GSDv is preferably about 1.30 or less and a ratio thereof to a number average particle size distribution index GSDp, GSDv/GSDp, is more preferably about 0.95 or more. When the volume average particle size distribution index GSDv exceeds about 1.30, the resolution may deteriorate, and when the ratio of the volume average particle size distribution index GSDv to the number average particle size distribution index GSDp, GSDv/GSDp, is less than about 0.95, in some cases, the charging property may be caused to deteriorate and at the same time image defect such as scattering and fogging may be caused.

Values of the foregoing volume average particle diameter and the particle size distribution indices are calculated as follows. In the beginning, a particle size distribution of the toner measured with COULTER COUNTER TA II (trade name, manufactured by Beckman-Coulter Co., Ltd.) as a measurement device is divided into particle diameter ranges (channels). A volume and number of toner particles in each of the channels is depicted as a cumulative distribution from a small diameter side, particle diameters where the cumulative values become 16% are defined as a volume average particle diameter $D_{16v}$ and a number average particle diameter $D_{16p}$, and particle diameters where the cumulative values become 50% are defined as a volume average particle diameter $D_{50v}$ (this value is taken as a volume average particle diameter) and a number average particle diameter $D_{50p}$ (this value is taken as a number average particle diameter). Similarly, particle diameters where the cumulative values become 84% are defined as a volume average particle diameter $D_{84v}$ and a number average particle diameter $D_{84p}$. With these values, the volume average particle diameter distribution index GSDv is defined as $(D_{84v}/D_{16v})_{1/2}$, and the number average particle diameter distribution index GSDp is defined as $(D_{84p}/D_{16p})_{1/2}$.

Furthermore, a shape factor SF1 of the toner in the invention is preferably in a range of about 110 to 140.

When the shape factor SF1 is set in a range of about 110 to 140, a coverage ratio of the shell can be readily made higher in the core/shell structure.

The foregoing shape factor SF1 can be herein obtained according to the following Equation (5).

$$SF1=(ML^2/A)\times(\pi/4)\times 100 \qquad \text{Equation (5)}$$

In Equation (5), ML denotes an absolute maximum length of a toner particle and A denotes a projection area of the toner particle.

The SF1 can be quantified by analyzing mainly a microscope image or a scanning electron microscope (SEM) image by use of an image analyzer. It can be calculated, for instance, as shown below. That is, a microscope image of toner particles sprayed on a slide glass surface is taken into a Luzex image analyzer through a video camera, the maximum length and the projection area of each of about 100 or more toner particles are obtained, the SF1 is calculated according to Equation (5), followed by obtaining an average value.

The toner particles in the invention can be prepared according to any one of a kneading and pulverizing process, a suspension polymerizing process, a dissolution and suspension process, and an emulsion flocculating and uniting process; however, an emulsion-polymerization flocculation and unification process, since it can give a sharp particle size distribution and is easy in controlling a toner shape and a toner surface property (core/shell structure), is preferable as a method that can satisfy the foregoing requirement.

A process of preparing an electrostatic latent image developing toner according to the invention by means of the emulsion-polymerization flocculation process will be described later.

On the other hand, when toner particles in the invention are obtained by means of the kneading and pulverizing process, in the beginning, a resin (binder resin), a colorant, a releasing agent and so on that are described later in the emulsion-polymerization flocculation process are blended by use of a blender such as a Nauta Mixer or Henschel Mixer, followed by kneading by means of such as a uniaxial or a biaxial extruder. This is rolling-milled and cooled, followed by finely pulverizing by use of a mechanical or air pulverizer typical in an I type mill, KTM, and jet mill, further followed by classification with use of a classifier that uses Coanda effect such as an elbow jet or an air classifier such as a Turbo-classifier and an AccuCut. Furthermore, a dry process of planting particles of resin on a surface of the prepared toner particles may be applied.

A charge amount of the toner for developing electrostatic latent image according to the invention is preferably in a range of about 20 to 40 μC/g by absolute value and more preferably in a range of about 15 to 35 μC/g. When the charge amount is less than about 20 μC/g, the background contamination (fogging) is likely to occur, and when it exceeds about 40 μC/g, the image density tends to decrease. Furthermore, a ratio of a charge amount of the toner for developing electrostatic latent image in summer season (high temperature and high humidity) to that in winter season (low temperature and low humidity) is preferably in a range of about 0.5 to 1.5, and more preferably in a range of about 0.7 to 1.3. When the ratio is outside of the range, since the dependency of the charging property to environment becomes high and the charging becomes less stable, which is unfavorable from a practical point of view.

When the foregoing respective toner characteristics are satisfied, an image forming method, that enables fixation of the toner at a low temperature, maintains high glossiness of a formed image in the oil-less fixing even in a process from low speed to high speed, and excellent in the blocking resistance, can be obtained.

Method for Forming Color Toner

The color toner used in the present invention can be formed by a method comprising: aggregating respective particles in a releasing agent dispersion by using aluminum ions in a mixture that is obtained by mixing a colorant dispersion, the releasing agent dispersion, and a resin particle dispersion comprising crystalline resin particles and first non-crystalline resin particles, so as to form aggregated particles; adhering second non-crystalline resin particles to the aggregated particles; and coalescing the second non-crystalline resin particles to the aggregated particles by terminating growth of the aggregated particles adhered to the second non-crystalline resin particles and then heating to a temperature which is equal to or higher than a glass transition temperature of the second non-crystalline resin particles, wherein: an average diameter of each of the crystalline resin particles, the first non-crystalline resin particles and the second non-crystalline resin particles is equal to or less than 1 μm; and the second non-crystalline resin particles have a different solubility parameter SP value from that of the aggregated particles.

Such an emulsion-aggregation coalescence process is preferable from a viewpoint of applying designs having separated functions as in the toner according to the invention.

Specifically, this method includes using a dispersion of resin particles in which resin particles which are generally manufactured according to an emulsion polymerizing process are dispersed by use of an ionic surfactant, mixing therewith a colorant dispersion obtained by dispersing by use of an ionic surfactant having the polarity opposite to that of the foregoing surfactant so as to form heteroaggregates, aggregating the heteroaggregates to form aggregated particles having a toner diameter, heating the aggregated particles to or higher than a glass transition temperature of a non-crystalline resin that is normally contained in the aggregates so as to melt-coalescing the aggregates, and washing and drying the resultant.

In the invention, a binder resin contains a crystalline resin and a non-crystalline resin; accordingly, crystalline resin particles and non-crystalline resin particles are prepared as resin particles.

A dispersion of crystalline resin particles can be obtained by subjecting the crystalline resin particles to a known inverse emulsification or by heating the crystalline resin particles to a temperature equal to or higher than the melting point and applying mechanical shear to emulsify. At this time, an ionic surfactant and so on may be added thereto. Furthermore, the dispersion of non-crystalline resin particles is preferably manufactured by a process similar to the manufacturing process of the crystalline resin particles. In the case where the dispersion of non-crystalline resin is a emulsion-polymerizable resin such as a styrene-acrylic resin, the dispersion of non-crystalline resin can be prepared by dispersing resin particles prepared according to emulsion polymerization in a solvent by using an ionic surfactant or the like.

Furthermore, the colorant dispersion can be prepared, with an ionic surfactant having a polarity opposite to that of an ionic surfactant which is used in preparing the dispersion of resin particles, by dispersing colorant particles having a desired color such as blue, red or yellow color in a solvent. Still furthermore, the dispersion of releasing agent can be prepared by dispersing a releasing agent in water together with an ionic surfactant and a polymer electrolyte such as a polymer acid or a polymer base, followed by pulverizing the releasing agent into microparticles by use of a homogenizer or a pressure discharge disperser that can heat the particles to a temperature which is equal to or more than a melting point and apply strong shear.

A particle diameter of resin particles in a dispersion of resin particles in the invention is about 1 μm or less by volume average particle diameter, and preferably in a range of about 100 to 300 nm, for both of the crystalline resin and the non-crystalline resin. When the volume average particle diameter exceeds 1 μm, a particle size distribution of toner particles that are obtained by flocculating and melting becomes broader or free particles are generated, and the reliability of performance of the toner may deteriorate. When the volume average particle diameter is less than about 100 nm, in some cases, a long time is necessary for flocculating and growing toner particles to be industrially impractical. When it exceeds about 300 nm, in some cases, the releasing agent and colorant are irregularly dispersed and the surface property of toner can be controlled with difficulty.

With regard to a particle diameter of the dispersion of resin particles, a particle size distribution of the toner can be measured by using a laser diffraction particle size distribution analyzer such as LA-700 (trade name, manufactured by Horiba, Ltd.). A volume of each of the toner particles is depicted as a cumulative distribution from a small diameter side, and the particle diameter where the cumulative values become 50% is defined as $D_{50v}$.

In the aggregating, the respective particles in the dispersion of resin particles, the colorant dispersion and, as needs arise, the dispersion of releasing agent, which are mutually mixed, aggregate to form aggregated particles. The process may be carried out by mixing the respective dispersions in lump to aggregate, and may further include adhering as described below.

That is, in the aggregating, amounts of initial ionic dispersants of the respective polarities are beforehand set off-balance, this is ionically neutralized with a polymer of an inorganic metal salt such as aluminum polychloride, after forming and stabilizing first stage matrix aggregates at a temperature equal to or less than the glass transition temperature, as a second stage, a dispersion of the non-crystalline resin particles (hereinafter occasionally referred as "additional particles") which are processed with a dispersant having the polarity and an amount that compensate the deviation from the balance is added, furthermore, as needs arise, followed by heating at a temperature slightly lower than the glass transition temperature of the additional resin particles, further followed by heating at a higher temperature to stabilize to form adhesion particles (adhering). Subsequently, with the resin particles added in the second stage of the aggregating by heating to a temperature equal to or higher than the glass transition temperature adhered on a surface of matrix-aggregated particles, coalescing is conducted (melt-coalescing). Furthermore, a step-wise operation of the aggregating (including adhering) may be repeated by a plurality of times.

In the invention, as mentioned above, a core/shell structure is preferable as a structure of the toner. Toner particles having such a structure can be preferably prepared according to an emulsion-aggregation coalescing process having the foregoing adhering.

Accordingly, the following process will be described with a focus on a manufacturing method of toner having a core/shell structure containing adhering.

In the aggregating, it is necessary that the respective dispersions are mixed in the presence of an aluminum ion to form aggregated particles. As at least one kind of a polymer of metal salt that is added with this intention, the polymer of a metal salt is preferably a polymer of tetravalent aluminum salt or a mixture of a polymer of tetravalent aluminum salt and a polymer of trivalent aluminum salt. Specific examples of the polymer include a polymer of an inorganic metal salt such as aluminum sulfate or a polymer of an inorganic metal salt such as aluminum polychloride. Furthermore, these polymers of metal salt are preferably added so that a concentration thereof may be in a range of about 0.05 to 0.30% by mass, and preferably is in a range of about 0.11 to 0.25% by mass, based on a total mass of the dispersion of resin particles.

The aggregating preferably includes: at least a first aggregating, in which a dispersion of resin particles in which crystalline resin particles having a volume average particle diameter of about 1 μm or less and non-crystalline particles are dispersed, a colorant dispersion in which colorant particles are dispersed, and a releasing agent dispersion in which releasing agent particles are dispersed are mixed to form core-aggregated particles containing the crystalline resin particles and non-crystalline resin particles, the colorant particles, and the releasing agent particles; and a second aggregating, in which a shell layer containing the non-crystalline resin particles is formed on a surface of the core-aggregated particles so as to obtain aggregated particles having a core/shell structure.

In the first aggregating, a combination of a dispersion of crystalline resin particles and non-crystalline resin particles, a dispersion of colorant particles, and a dispersion of releasing agent particles are prepared. However, since particles of a non-crystalline resin are used as the resin particles for forming the shell layer in the invention, the dispersion of particles of crystalline resin may be singly used in the first aggregating instead of the combination of the dispersion of the crystalline resin particles and the non-crystalline resin particles.

In the next place, the dispersion of crystalline resin particles, the non-crystalline resin particles, the colorant dispersion and the releasing agent dispersion are mixed so as to allow the resin particles, colorant particles and releasing agent particles to undergo hetero-aggregation to form aggregated particles (core-aggregated particles) having a diameter substantially equal to a desired toner diameter.

Furthermore, he non-crystalline resin particles are adhered on a surface of the core-aggregated particle by using a resin particle dispersion containing the non-crystalline resin particles so as to form a coating layer (shell layer) having a desired thickness, and thereby aggregated particles (core/shell aggregate particles) that have a core/shell structure having a shell layer formed on a surface of the core-aggregated particle can be obtained.

Herein, the aggregated particles in the first aggregating (core aggregated particles) and the non-crystalline resin particles added in the second aggregating have different solubility parameter SP values. The difference of the solubility parameter SP values of these particles is preferably 0.05 to 1 and more preferably 0.1 to 0.8. In the case the SP value is the same, compatible solvation proceeds and Tg is lowered below that of the resin composing the core to result in the possibility of deterioration of heat preservation property and fluidity.

In the invention, SP value (solubility parameter) means the value calculated according to the Fedors method. The SP value in this case can be defined by the following equation.

$$SP\ \text{value}=(E/V)^{1/2}=(\Sigma ei/\Sigma vi)^{1/2} \qquad \text{Equation (6)}$$

In Equation (6), SP value represents the solution parameter; E represents aggregation energy (cal/mol); V represents volume per mole ($cm^3$/mol); ei represents evaporation energy of atom or atom group at time i (cal/atom or atom group); and vi represents volume per mole of atom or atom group at time i ($cm^3$/atom or atom group); and i represents an integer of 1 or higher.

References of the calculation method and the data of evaporation energy of each atom group ei and volume per mole vi can be found in Minoru Imoto et. al, Basic Theory of Adhesion, Chapter. 5, Polymer Publisher and R. F. Fedors, Polym. Eng. Sci, 14, 147 (1974).

The SP value defined by Equation (6) is calculated in units of $cal^{1/2}/cm^{3/2}$ and expressed nondimensionally. Additionally, in the invention, since the relative difference of the SP value between two compounds has significant meaning, the calculated value is conventionally employed and expressed nondimensionally.

By way of information, when the SP value defined by Equation (6) is converted into the SI unit ($J^{1/2}/m^{3/2}$), 1 cal=4.18605 J may be applied.

In the invention, examples of surfactants that are used to disperse, aggregate or stabilize the resin, colorant and releasing agent include anionic surfactants such as sulfate ester salt surfactants, sulfonate surfactants, phosphate ester salt surfactants, or soap anionic surfactants; cationic surfactants such as amine salt surfactants or quaternary ammonium salt surfactants; polyethylene glycol surfactants; and alkyl phenol ethylene oxide adduct surfactants. Polyvalent alcohol nonionic surfactants can also be effectively used in combination thereto. Examples of a device for dispersing include those that can be generally used such as a rotary shear homogenizer, or a ball mill, a sand mill, a dyno mill and the like which use media.

Subsequently, an atmosphere of the aggregated particles is preferably adjusted to be in a range of about 6 to 10 of pH do as to terminate growing of the aggregated particles, followed by coalescing, which includes heating the core/shell aggregated particles obtained through the aggregating process in a solution to a temperature which is equal to or higher than a glass transition temperature of the non-crystalline resin particles contained in the shell of the aggregated particle so as to melt-coalesce the aggregated particles and the non-crystalline resin particles contained in the shell, and thereby the toner of the invention is formed.

In the melt-coalescing step, "coalesce (coalescing)" includes not only the case when the non-crystalline resin particles added to the shell layer forming resin are completely melted and form a single layer by heating but also the case when the surfaces of the non-crystalline resin particles are melted and the non-crystalline resin particles adhere to the aggregated particles to form one particle.

After the foregoing aggregating (including adhering) and melt-coalescing, and optionally undergoing washing, solid/liquid separating and drying, a desired toner is obtained. In the washing, displacement washing with ion-exchange water is preferably sufficiently applied from the viewpoint of the charging property. Furthermore, though the solid/liquid separating is not particularly restricted, suction filtering and pressure filtering are preferably used therefore from the viewpoint of productivity. Still furthermore, though the drying is neither particularly restricted, freeze-drying, flash-jet drying, fluidized drying and vibration fluidized drying and so on can be preferably used from the viewpoint of productivity.

The toner for developing electrostatic latent image according to the invention can be manufactured by preparing toner particles (matrix particles) as mentioned above, followed by adding the foregoing inorganic particles to the toner, further followed by mixing by use of a Henschel mixer or the like.

As a manufacturing method of the toner for developing electrostatic latent image according to the invention, the description was focused on the manufacturing method of the toner having the core/shell structure. However, the invention is not restricted thereto. Even when toner particles do not have a shell layer, there is no problem as far as the toner satisfies the foregoing characteristics.

EXAMPLES

The invention will be described with reference to examples. However, the invention is not restricted to the examples. In the description below, as far as not particularly stated, "parts" and "%" all mean "parts by mass" and "% by mass".

Preparation of Toner

A summary for forming toners in the Examples is as follows.

That is, at least a dispersion of non-crystalline resin particles having a volume average particle diameter of 1 μm or less and/or a dispersion of crystalline resin particles are mixed at a specific ratio, followed by mixing thereto a colorant dispersion and a releasing agent dispersion, further followed by aggregating and growing with at least one kind of metal salt including polyaluminum chloride at a temperature in a range of about 45 to 65° C. (aggregating).

Subsequently, thereto, non-crystalline resin particles which are same as or different from those used in the aggregating are further added to form a shell layer (adhering). The aggregating and adhering are respectively once conducted in the Examples, though step-wise operations of the aggregating and adhering may be repeated a plurality of times in the invention.

Thereafter, the pH of an atmosphere where aggregated particles exist is maintained in a range of about 6.0 to 10.0 to terminate the growth of the aggregated particles, followed by heating to a temperature of equal to or more than the glass transition temperature or the melting point of the resin so as to melt-coalesce to an extent that a toner surface is fused, further followed by cooling the resultant to a temperature of equal to or less than about 40° C., and thereby a toner is obtained.

Subsequently, a desired toner can be obtained by appropriately applying washing and drying thereto.

Processes of preparing the respective dispersions and an example of manufacture of toner will be described in the followings in detail.

Synthesis of Respective Resin Materials

Crystalline Polyester Resin

Into a heated and dried three-mouthed flask, approximately 160.0 parts of 1,10-decanediol, approximately 40.0 parts of dimethyl sodium 5-sulfoisophthalate, approximately 8 parts of dimethyl sulfoxide and approximately 0.02 parts of dibutyltin oxide as a catalyst are poured, followed by depressurizing air in a vessel and introducing nitrogen to render an inert atmosphere, further followed by mechanically agitating at about 180° C. for about 3 hr. Thereafter, under reduced pressure, dimethyl sulfoxide is distilled, and, under flow of nitrogen, about 23.0 parts of dimethyl dodecane dioic acid is added followed by agitating at about 180° C. for about 1 hr.

Thereafter, the temperature is gradually increased to about 220° C. under reduced pressure, followed by stirring for about 30 min. When the mixture becomes a viscous state, the mixture is cooled by air and the reaction is stopped. Thereby, about 360 parts of a crystalline polyester resin is synthesized.

The weight average molecular weight (Mw) of the crystalline polyester resin, which is obtained by a molecular weight measurement according to gel permeation chromatography (polystyrene conversion), is about 24,200, and the number average molecular weight (Mn) thereof is about 8,900. Furthermore, the melting point (Tm) of the crystalline polyester resin is measured with a differential scanning calorimeter (DSC) in accordance with the aforementioned measuring method. The melting point has a clear peak and the peak top temperature is about 73° C.

| Non-crystalline polyester resin (1) | |
|---|---|
| Dimethyl naphthalene dicarboxylate | 121 parts |
| Dimethyl terephthalate | 98 parts |
| Ethylene oxide adduct of bisphenol A | 220 parts |
| Ethylene glycol | 70 parts |
| Tetrabutoxy titanate | 0.07 parts |

Into a heated and dried three-mouthed flask, the foregoing respective components are poured, followed by heating at a temperature in a range of about 170 to 226° C. for about 180 min to carry out an ester exchange reaction. Subsequently, the reaction is continued at about 220° C., the pressure of a system is set in a range of about 133.3 to 1,333 Pa (1 to 10 mm Hg) for 60 min, and thereby a non-crystalline polyester resin (1) is obtained. The glass transition temperature of the non-crystalline polyester resin (1) is about 79° C.

| Non-crystalline polyester resin (2) | |
|---|---|
| Dimethyl terephthalate | 96 parts |
| Dimethyl isophthalate | 96 parts |
| Ethylene oxide adduct of bisphenol A | 159 parts |
| Ethylene glycol | 100 parts |
| Tetrabutoxy titanate | 0.07 parts |

Into a heated and dried three-mouthed flask, the foregoing respective components are poured, followed by heating at a temperature in a range of about 170 to 220° C. for about 180 min to carry out an ester exchange reaction. Subsequently, the reaction is continued at about 220° C., the pressure of a system is set in a range of about 133.3 to 1,333 Pa (1 to 10 mm Hg) for 60 min, and thereby a non-crystalline polyester resin (2) is obtained. The glass transition temperature of the non-crystalline polyester resin (2) is about 54° C.

| Non-crystalline polyester resin (3) | |
|---|---|
| Dimethyl terephthalate | 57 parts |
| Dimethyl isophthalate | 77 parts |
| Succinic acid anhydride | 30 parts |
| Ethylene oxide adduct of bisphenol A | 156 parts |
| Ethylene glycol | 99 parts |
| Tetrabutoxy titanate | 0.07 parts |

Into a heated and dried three-mouthed flask, the foregoing respective components are poured, followed by heating at a temperature in a range of about 170 to 220° C. for about 180 min to carry out an ester exchange reaction. Subsequently, the reaction is continued at 220° C., the pressure of a system is set in a range of about 133.3 to 1,333 Pa (1 to 10 mm Hg) for about 60 min, and thereby a non-crystalline polyester resin (3) is obtained. The glass transition temperature of the non-crystalline polyester resin (3) is about 48° C.

| Non-crystalline polyester resin (4) | |
|---|---|
| Dimethyl naphthalene dicarboxylate | 145 parts |
| Dimethyl terephthalate | 77 parts |
| Ethylene oxide adduct of bisphenol A | 220 parts |
| Ethylene glycol | 70 parts |
| Tetrabutoxy titanate | 0.07 parts |

Into a heated and dried three-mouthed flask, the foregoing respective components are poured, followed by heating at a temperature in a range of about 170 to 220° C. for about 180 min to carry out an ester exchange reaction. Subsequently, the reaction is continued at about 220° C., the pressure of a system is set in the range of about 133.3 to 1,333 Pa (1 to 10 mm Hg) for about 60 min, and thereby a non-crystalline polyester resin (4) is obtained. The glass transition temperature of the non-crystalline polyester resin (4) is about 82° C.

Preparation of Dispersion of Resin Particles

| Dispersion of Resin Particles (1) | |
|---|---|
| Crystalline polyester resin | 115 parts |
| Ionic surfactant (trade name: NEOGEN RK, manufactured by Dai-ichi Kogyo Seiyaku Co., Ltd.) | 5 parts |
| Ion exchange water | 180 parts |

The foregoing materials are mixed and heated at about 100° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (1) having a volume average particle diameter of about 230 nm and a solid content of about 40% is obtained.

The volume average particle diameter D50 v of the dispersed particles in the resin fine particle dispersion is measured by a laser diffraction type particle size distribution measurement apparatus (trade name: LA-700, described above).

The solid matter amount is measured as follows. At first, the weight of a 50 cc beaker made of polypropylene is accurately measured to the 0.1 mg level by a balance. The weight is defined as A. About 1 g of the dispersion is added and the weight is accurately measured also to the 0.1 mg level by a balance. The weight is defined as B. The beaker is then put in a drying apparatus (trade name: VOS-451 SD, manufactured by Yamato Kagaku Co., Ltd.) and left at 120° C. for 30 minutes. The beaker is taken out after 30 minutes and spontaneously cooled to room temperature and then the weight is measured accurately to the 0.1 mg level. The weight is defined as C. The solid matter amount is calculated according to the following equation.

$$\text{Solid matter weight}=100\times(C-A)/(B-A)(\%)$$

Hereinafter, the volume average particle diameter of the particles in the dispersion and the solid matter amount are the values measured by the above-mentioned methods.

| Dispersion of Resin Particles (2) | |
|---|---|
| Non-crystalline polyester resin (1) | 115 parts |
| Ionic surfactant (trade name: DOWFAX 2A1, manufactured by Dow Chemical Co., Ltd.) | 5 parts |
| Ion exchange water | 180 parts |

The foregoing materials are mixed and heated at about 180° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (2) having a volume average particle diameter of about 200 nm and a solid content of about 40% is obtained.

| Dispersion of Resin Particles (3) | |
|---|---|
| Non-crystalline polyester resin (2) | 115 parts |
| Ionic surfactant (trade name: DOWFAX 2K1, manufactured by Dow Chemical Co., Ltd.) | 5 parts |
| Ion exchange water | 180 parts |

The foregoing materials are mixed and heated at about 180° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (3) having a volume average particle diameter of about 220 nm and a solid content of about 40% is obtained.

| Dispersion of Resin Particles (4) | |
|---|---|
| Non-crystalline polyester resin (3) | 115 parts |
| Ionic surfactant (trade name: DOWFAX 2K1, manufactured by Dow Chemical Co., Ltd.) | 5 parts |
| Ion exchange water | 180 parts |

The foregoing materials are mixed and heated at about 180° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (4) having a volume average particle diameter of about 250 nm and a solid content of about 40% is obtained.

| Dispersion of Resin Particles (5) | |
|---|---|
| Non-crystalline polyester resin (4) | 115 parts |
| Ionic surfactant (trade name: NEOGEN RK, manufactured by Dai-ichi Kogyo Seiyaku Co., Ltd.) | 5 parts |
| Ion exchange water | 180 parts |

The foregoing materials are mixed and heated at about 180° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (5) having a volume average particle diameter of about 200 nm and a solid content of about 40% is obtained.

| Dispersion of Resin Particles (6) | |
|---|---|
| Crystalline polyester resin | 23 parts |
| Non-crystalline polyester resin (1) | 92 parts |
| Ionic surfactant (trade name: NEOGEN RK, manufactured by Dai-ichi Kogyo Seiyaku Co., Ltd.) | 5 parts |
| Ion exchange water | 180 parts |

The foregoing materials are mixed and heated at about 180° C., followed by thoroughly dispersing by use of a homogenizer (trade name: ULTRA-TURRAX T-50, manufactured by IKA KK), further followed by dispersing by use of a pressure discharge type Gaulin Homogenizer for about 1 hr, and thereby a dispersion of resin particles (6) having a volume average particle diameter of about 190 nm and a solid content of about 40% is obtained.

| Preparation of Colorant Dispersion | |
|---|---|
| Cyan pigment (trade name: COPPER PHTHALOCYANINE B-15: 3, manufactured by Dainichiseika Color &Chemicals Mfg. Co., Ltd.) | 45 parts |
| Ionic surfactant (NEOGEN RK, manufactured by Dai-ichi Kogyo Seiyaku Co., Ltd.) | 5 parts |
| Ion exchange water | 200 parts |

The foregoing materials are mixed and dissolved, followed by dispersing with a homogenizer (trade name: ULTRA-TURRAX T-50, manufactured by IKA KK) for about 10 min, and thereby a colorant dispersion having a volume average particle diameter of about 138 nm is obtained.

| Preparation of Releasing Agent Dispersion | |
|---|---|
| Paraffin Wax HNP9 (melting point: 68° C., manufactured by Nihon Seirou Co., Ltd.) | 45 parts |
| Cationic surfactant (Neogen RK, manufactured by Dai-ichi Kogyo Seiyaku Co., Ltd.) | 5 parts |
| Ion exchange water | 200 parts |

The foregoing materials are mixed and heated at about 60° C., followed by thoroughly dispersing by use of a homogenizer (trade name: ULTRA-TURRAX T-50, manufactured by IKA KK), further followed by dispersing by use of a pressure discharge type Gaulin Homogenizer, and thereby a releasing agent dispersion having a volume average particle diameter of about 190 nm and a solid content of about 25% is obtained.

Preparation of Toner Particles

With materials prepared as mentioned above, according to an emulsion aggregation and unification process, toner particles are prepared.

| Toner particles 1 | |
|---|---|
| Dispersion of resin particles (1) | 20 parts |
| Dispersion of resin particles (2) | 60 parts |
| Colorant dispersion | 60 parts |
| Releasing agent dispersion | 60 parts |
| Polyaluminum chloride | 0.36 parts |

The foregoing respective components are poured into a round stainless steel flask, followed by thoroughly mixing and dispersing with ULTRA-TURRAX T-50 (described above). In the next place, about 0.36 parts of aluminum polychloride is added, followed by continuing to disperse by use of the ULTRA-TURRAX T-50 (described above). The flask, while heating to about 47° C. with a heating oil-bath under agitation, is kept at this temperature for about 60 min, followed by slowly adding thereto about 31 parts of the dispersion of resin particles (2). Thereafter, a about 0.5 mol/L sodium hydroxide aqueous solution is added to control the pH in the system at about 9.5, followed by closely sealing the stainless flask, further followed by heating, while continuing to mix by use of a magnetic seal, up to about 96° C. and holding for about 5 hr.

A solubility parameter SP value of the aggregated particles is 11.3, and a solubility parameter SP value of the non-crystalline polyester resin (1) contained in the dispersion of resin particles (2) is 10.58.

After the reaction comes to completion, the mixture is cooled, filtered and thoroughly washed with ion-exchange water, followed by applying solid/liquid separation by use of a Nutsche suction filter. This is further dispersed at about 40 degrees centigrade in 3 L of ion exchange water, followed by agitating and washing at about 300 rpm for about 15 min. The process is further repeated by 5 times. A filtrate, when the pH, electrical conductivity and surface tension thereof, respectively, become about 7.01, about 9.8 μS/cm and about 71.1 Nm, is subjected, by use of a Nutsche suction filter, to the solid/liquid separation with No. 5A filter paper. Subsequently, vacuum drying is continued for 12 hr to obtain toner particles 1.

A particle size distribution of the toner particles 1 is measured with a COULTER COUNTER TAII (trade name, manufactured by Beckman-Coulter Co., Ltd.) and a volume average particle diameter and a volume average particle size distribution index GSDv, respectively, are found to be about 6.1 μm and about 1.22. Furthermore, the shape factor SF1 of particles obtained from shape observation by use of a Luzex image analyzer is 131.4, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 0.6 μm.

Toner Particles 2

Except that initial addition amounts of the dispersion of resin particles (1) and the dispersion of resin particles (2) are set at about 10 parts and about 80 parts, respectively, toner particles 2 are prepared in a similar manner as for the toner particles 1. A solubility parameter SP value of the aggregated particles therein is 11.3.

A particle size distribution of the toner particles 2 is measured with a COULTER COUNTER TAII (trade name, manufactured by Beckman-Coulter Co., Ltd.) and a volume average particle diameter and a volume average particle size distribution index GSDv, respectively, are found to be about 6.3 μm and about 1.24. Furthermore, the shape factor SF1 of particles obtained from shape observation by use of a Luzex image analyzer is about 128, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 1.3 μm.

Toner Particles 3

Except that initial addition amounts of the dispersion of resin particles (1) and the dispersion of resin particles (2) are set at about 37 parts and about 43 parts, respectively, toner particles 3 are prepared in a similar manner as for the toner particles 1. A solubility parameter SP value of the aggregated particles therein is 11.3.

A particle size distribution of the toner particles 3 is measured with a COULTER COUNTER TA II (trade name, manufactured by Beckman-Coulter Co., Ltd.) and a volume average particle diameter and a volume average particle size distribution index GSDv, respectively, are found to be about 6.2 μm and about 1.20. Furthermore, the shape factor SF1 of particles obtained from shape observation by use of a Luzex image analyzer is about 128.7, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 0.8 μm.

Toner Particles 4

Except that about 41 parts of the dispersion of resin particles (6) is used instead of the dispersion of resin particles (1)

and the dispersion of resin particles (2), and about 30 parts of the dispersion of resin particles (2) is added in the middle of the preparation, toner particles 4 are prepared in a similar manner as for the toner particles 1. A solubility parameter SP value of the aggregated particles therein is 11.3.

A particle size distribution of the toner particles 4 is measured with a COULTER COUNTER TA II (trade name, manufactured by Beckman-Coulter Co., Ltd.) and a volume average particle diameter and a volume average particle size distribution index GSDv, respectively, are found to be about 5.9 μm and about 1.23. Furthermore, the shape factor SF1 of particles obtained from shape observation by use of a Luzex image analyzer is about 128.7, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 0.9 μm.

Toner Particles 5

Except that the dispersion of resin particles (3) is used instead of the dispersion of resin particles (2), toner particles 5 are prepared in a similar manner as for the toner particles 1. A solubility parameter SP value of the aggregated particles is 10.3, and a solubility parameter SP value of the non-crystalline polyester resin (2) contained in the dispersion of resin particles (2) is 10.53.

A particle size distribution of the toner particles 5 is measured with a COULTER COUNTER TA II (trade name, manufactured by Beckman-Coulter Co., Ltd.) and a volume average particle diameter and a volume average particle size distribution index GSDv, respectively, are found to be about 5.7 μm and about 1.24. Furthermore, the shape factor SF1 of particles obtained from shape observation by use of a Luzex image analyzer is about 133.4, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 0.3 μm.

Toner Particles 6

Except that the dispersion of resin particles (4) is used instead of the dispersion of resin particles (1), toner particles 4 are prepared in a similar manner as for the toner particles 1. A solubility parameter SP value of the aggregated particles therein is 9.57.

A particle size distribution of the toner particles 4 is measured with a COULTER COUNTER TA II (trade name, manufactured by Beckman-Coulter Co., Ltd.) and a volume average particle diameter and a volume average particle size distribution index GSDv, respectively, are found to be about 5.6 μm and about 1.22. Furthermore, the shape factor SF1 of particles obtained from shape observation by use of a Luzex image analyzer is about 132.0, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 1.6 μm.

Toner Particles 7

Except that about 60 parts of the dispersion of resin particles (1) is singly used instead of the combination of the dispersion of resin particles (1) and the dispersion of resin particles (2), and about 31 parts of the dispersion of resin particles (2) is added in the middle of the preparation, toner particles 7 are prepared in a similar manner as for the toner particles 1. A solubility parameter SP value of the aggregated particles therein is 11.3.

A particle size distribution of the toner particles 7 is measured with a COULTER COUNTER TA II (trade name, manufactured by Beckman-Coulter Co., Ltd.) and a volume average particle diameter and a volume average particle size distribution index GSDv, respectively, are found to be about 7.4 μm and about 1.20. Furthermore, the shape factor SF1 of particles obtained from shape observation by use of a Luzex image analyzer is about 126.3, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and a wetted perimeter of the releasing agent crystal is about 1.9 μm.

Toner Particles 8

Except that about 60 parts of the dispersion of resin particles (1) is singly used instead of the combination of the dispersion of resin particles (1) and the dispersion of resin particles (2), and no dispersion of resin particles is further added in the middle of the preparation, toner particles 8 are prepared in a similar manner as for the toner particles 1.

A particle size distribution of the toner particles 8 is measured with a COULTER COUNTER TA II (trade name, manufactured by Beckman-Coulter Co., Ltd.) and a volume average particle diameter and a volume average particle size distribution index GSDv, respectively, are found to be about 9.8 μm and about 1.36. Furthermore, the shape factor SF1 of particles obtained from shape observation by use of a Luzex image analyzer is about 117, that is, spherical.

Furthermore, in an observation with a transmission electron microscope (TEM), toner particles as a whole are not observed to have a core/shell structure. Furthermore, it is confirmed that rod-shaped and block-shaped releasing agent crystals mingle in a sea structure of a crystalline resin inside of the toner. A wetted perimeter of the releasing agent crystal is about 1.8 μm.

Toner Particles 9

Except that about 60 parts of the dispersion of resin particles (5) is singly used instead of the combination of the dispersion of resin particles (1) and the dispersion of resin particles (2), and no dispersion of resin particles is further added in the middle of the preparation, toner particles 9 are prepared in a similar manner as for the toner particles 1.

A particle size distribution of the toner particles 9 is measured with a COULTER COUNTER TA II (trade name, manufactured by Beckman-Coulter Co., Ltd.) and a volume average particle diameter and a volume average particle size distribution index GSDv, respectively, are found to be about 6.1 μm and about 1.25. Furthermore, the shape factor SF1 of particles obtained from shape observation by use of a Luzex image analyzer is about 146.0, that is, amorphous.

Furthermore, in an observation with a transmission electron microscope (TEM), toner particles as a whole are not observed to have a core/shell structure. Furthermore, it is confirmed that rod-shaped and block-shaped releasing agent crystals mingle in a sea structure of a crystalline resin inside of the toner. A wetted perimeter of the releasing agent crystal is about 0.3 μm.

Preparation of Developer

To approximately 50 parts of each of thus prepared toner particles 1 through 9, 1.0 parts of hydrophobic silica (trade name: TS 720, manufactured by Cabbot Corp.) is added, followed by blending by use of a sample mill at about 10,000 rpm for about 30 sec, and thereby toners 1 through 9 are prepared. Furthermore, each of these is weighed so that a toner concentration becomes about 5% relative to a ferrite carrier that is coated with about 1% of polymethacrylate (manufactured by Soken Chemical & Engineering Co., Ltd.) and has a volume average particle diameter of about 50 μm, followed by agitating by use of a ball mill for about 5 min to mix, and thereby developers 1 through 9 are prepared.

Evaluation of Fixation Property

As an image formation apparatus, modified apparatus DocuCentre Colore500 (trade name, manufactured by Fuji Xerox Co., Ltd.) is used and as a fixation apparatus, a fixation apparatus comprising an endless belt shown in FIG. 1 is used for carrying out fixation evaluation. The fixation apparatus shown in FIG. 1 comprises a supporting roller 12, a heating roller (a heating body) 14, and a pad 16 installed in the inside of a fixation belt (a film-like member) 10 and a counter roller (a pressurizing member) 18 installed in the outside of the fixation belt 10.

The fixation conditions are set as follows.

The sensor temperature T1 in the heating roller 14: 190° C.

The surface temperature T2 of the fixation belt 10 to be brought into contact with the counter roller 18: 176° C.

The temperature T3 of the film-like member 10 in the portion separated from the toner image surface: 174° C.

The speed of the fixation belt (film-like member) 10: 50, 150, 220, 350, 400 mm/sec The total pressure between the heating roller 14 and the counter roller 18: 15 kg The nip width between the counter roller 18 and the fixation belt (film-like member) 10: 3 mm The film-like member 10: a 15 μm-thick polyimide film material coated with polytetrafluoroethylene on whose surface a conductive material is dispersed (trade name: POLYIMIDE SEAMLESS BELT, manufactured by Nitto Denko Corp.)

Warm up time: 6 seconds

As a fixation apparatus for comparison, a commonly-used thermal roller fixation apparatus is employed.

As the roller for comparison, a hollow aluminum roller with a diameter of 30 mm and a thickness of 5 mm, coated with PFA and provided with a heat source for heating in the center is employed. The fixation temperature is set so as to adjust the temperature of the upper roller to be about 180° C. and, as a lower roller, a rubber roller with a diameter of 25 mm and made of silicon rubber is employed.

In the case of evaluation, the fixation speed is changed between 50, 150, 220, 350, and 400 mm/sec, J paper and Mirror Coat Platinum are respectively used as paper and gloss, and occurrence of offset, occurrence of image roughening, gloss and gloss distribution, are visually evaluated.

Example 1

The developer 1 (containing the toner particles 1) is packed, the toner disposition amount is adjusted to be 15.0 g/m$^2$ to form an image, and the fixation property is then evaluated.

In the entire temperature range and fixation speed range for the evaluation, the separation property from the fixation apparatus is found to be excellent without any resistance and offset is not at all caused. The gloss of the image is also good and a 60° mirror gloss measured in accordance with a conventionally-known method exceeds 60% in all cases.

With respect to the toner contained in the developer, the minimum value of the relaxation elasticity H in the relaxation spectrum calculated from the dynamic viscoelasticity measurement and frequency dependency according to the above-mentioned manner is 10 Pa/cm$^2$ and the relaxation time λ is 8,200 sec. The inclination K of the frequency dispersion curve of the storage elasticity at 60° C. is 0.52.

Example 2

Evaluations of the fixation property of Example 2 are conducted in the same manner as in Example 1, except that the developer 2 (containing the toner particles 2) is used in place of the developer 1.

In the entire temperature range and fixation speed range for the evaluation, the separation property from the fixation apparatus is found to be excellent without any resistance and offset is not at all caused. The gloss of the image is also good and the 60° mirror gloss exceeds 60% in all cases.

With respect to the toner contained in the developer, the minimum value of the relaxation elasticity H in the relaxation spectrum calculated from the dynamic viscoelasticity measurement and frequency dependency according to the above-mentioned manner is 890 Pa/cm$^2$ and the relaxation time λ is 1,000 sec. The inclination K of the frequency dispersion curve of the storage elasticity at 60° C. is 0.86.

Example 3

Evaluations of the fixation property of Example 3 are conducted in the same manner as in Example 1, except that the developer 3 (containing the toner particles 3) is used in place of the developer 1.

In the entire temperature range and fixation speed range for the evaluation, the separation property from the fixation apparatus is found to be excellent without any resistance and offset is not at all caused. The gloss of the image is also good and the 60° mirror gloss exceeds 60% in all cases.

With respect to the toner contained in the developer, the minimum value of the relaxation elasticity H in the relaxation spectrum calculated from the dynamic viscoelasticity measurement and frequency dependency according to the above-mentioned manner is 370 Pa/cm$^2$ and the relaxation time λ is 2 sec. The inclination K of the frequency dispersion curve of the storage elasticity at 60° C. is 0. 13.

Example 4

Evaluations of the fixation property of Example 4 are conducted in the same manner as in Example 1, except that the developer 4 (containing the toner particles 4) is used in place of the developer 1.

In the entire temperature range and fixation speed range for the evaluation, the separation property from the fixation apparatus is found to be excellent without any resistance and offset is not at all caused. The gloss of the image is also good and the 60° mirror gloss exceeds 60% in all cases.

With respect to the toner contained in the developer, the minimum value of the relaxation elasticity H in the relaxation spectrum calculated from the dynamic viscoelasticity measurement and frequency dependency according to the above-mentioned manner is 760 Pa/cm$^2$ and the relaxation time λ is 6,700 sec. The inclination K of the frequency dispersion curve of the storage elasticity at 60° C. is 0.70.

Example 5

Evaluations of the fixation property of Example 5 are conducted in the same manner as in Example 1, except that the developer 7 (containing the toner particles 7) is used in place of the developer 1.

In the entire temperature range and fixation speed range for the evaluation, the separation property from the fixation apparatus is found to be excellent without any resistance and offset is not at all caused. The gloss of the image is also good and the 60° mirror gloss exceeds 60% in all cases.

With respect to the toner contained in the developer, the minimum value of the relaxation elasticity H in the relaxation spectrum calculated from the dynamic viscoelasticity measurement and frequency dependency according to the above-mentioned manner is 13 Pa/cm$^2$ and the relaxation time λ is 9,900 sec. The inclination K of the frequency dispersion curve of the storage elasticity at 60° C. is 0.70.

Comparative Example 1

Evaluations of the fixation property of Comparative example 1 are conducted in the same manner as in Example 1, except that the developer 6 (containing the toner particles 6) is used in place of the developer 1.

In the fixation speed range for the evaluation of equal to or less than 100 mm/sec, the separation property from the fixation apparatus is found to be excellent. However, in the fixation speed range for the evaluation of more than 100 mm/sec, cold off-set phenomena are caused. The gloss of the image is also in a low value.

With respect to the toner contained in the developer, the minimum value of the relaxation elasticity H in the relaxation spectrum calculated from the dynamic viscoelasticity measurement and frequency dependency according to the above-mentioned manner is 8 Pa/cm$^2$ and the relaxation time λ is 0.08 sec. The inclination K of the frequency dispersion curve of the storage elasticity at 60° C. is 0.89.

Comparative Example 2

Evaluations of the fixation property of Comparative example 2 are conducted in the same manner as in Example 1, except that the developer 5 (containing the toner particles 5) is used in place of the developer 1.

In the fixation speed range for the evaluation of equal to or less than 200 mm/sec, the separation property from the fixation apparatus is found to be excellent. However, in the fixation speed range for the evaluation of more than 200 mm/sec, cold off-set phenomena are caused. In addition, hot off-set phenomena are caused in the fixation speed range for the evaluation of 50 mm/sec.

With respect to the toner contained in the developer, the minimum value of the relaxation elasticity H in the relaxation spectrum calculated from the dynamic viscoelasticity measurement and frequency dependency according to the above-mentioned manner is 930 Pa/cm$^2$ and the relaxation time λ is 0.09 sec. The inclination K of the frequency dispersion curve of the storage elasticity at 60° C. is 0. 10.

Comparative Example 3

Evaluations of the fixation property of Comparative example 3 are conducted in the same manner as in Example 1, except that the developer 8 (containing the toner particles 8) is used in place of the developer 1.

In the fixation speed range for the evaluation of equal to or less than 200 mm/sec, cold off-set phenomena are caused. The gloss of the image is also in a low value.

With respect to the toner contained in the developer, the minimum value of the relaxation elasticity H in the relaxation spectrum calculated from the dynamic viscoelasticity measurement and frequency dependency according to the above-mentioned manner is 0.05 Pa/cm$^2$ and the relaxation time λ is 12,000 sec. The inclination K of the frequency dispersion curve of the storage elasticity at 60° C. is 0.09.

Comparative Example 4

Evaluations of the fixation property of Comparative example 4 are conducted in the same manner as in Example 1, except that the developer 9 (containing the toner particles 9) is used in place of the developer 1.

In the fixation speed range for the evaluation of equal to or less than 100 mm/sec, the separation property from the fixation apparatus is found to be excellent. However, in the fixation speed of 200 mm/sec, a cold off-set phenomenon is caused, and a satisfactory image is not obtained. Thus, the gloss of the image is not evaluated With respect to the toner contained in the developer, the minimum value of the relaxation elasticity H in the relaxation spectrum calculated from the dynamic viscoelasticity measurement and frequency dependency according to the above-mentioned manner is 9 Pa/cm$^2$ and the relaxation time λ is 0.8 sec. The inclination K of the frequency dispersion curve of the storage elasticity at 60° C. is 0.90.

As described above, the color toners of the invention used in the Examples exhibit good separation property, effective improvements in fixation speed dependency in image warping and fixation, and preservation property in the oil-less fixation at a low temperature, whereas the toners used in the Comparative Examples cause various problems in fixation, warping of images, and the like.

What is claimed is:

1. A color image forming method comprising:

charging a photosensitive body so as to form a latent image;

developing the latent image with a color toner so as to form a toner image on the photosensitive body;

transferring the toner image to an image transfer body via an intermediate transfer body so as to form a non-fixed transfer image; and fixing the non-fixed transfer image to the an image transfer body, wherein:

the fixing comprises thermally fixing the toner image to the an image transfer body by using:

a heating body installed in a fixed manner for heating the transfer body; and a pressurizing member which is positioned opposite to the heating body via a film-like member, brought into contact with the heating body with pressure, and rotated so as to press-contact the transfer body to the heating body;

the color toner comprises a toner particle comprising crystals of a crystalline resin, crystals of a releasing agent and a non-crystalline resin;

when the color toner is subjected to dynamic viscoelasticity measurement employing a sine wave vibration method, a minimum value of the relaxation elasticity H in a relaxation spectrum obtained from frequency dispersion characteristics when a measurement frequency measured at 60 and 80° C. is 0.1 to 100 rad/sec and a measurement strain at a frequency of 6.28 rad/sec is 0.1%, is in a range of about 10 to 900 $Pa/cm^2$; and a relaxation time λ corresponding to the minimum value is in a range of about 1 to 10,000 sec.

2. The color image forming method according to claim 1, wherein a gradient K, which is a frequency dispersion curve of a storage elasticity with frequency dispersion characteristics measured at 60° C. with a measurement strain set at a measurement frequency of 6.28 rad/sec being 0.1%, is in a range of about 0.12 to 0.87 $Pa/cm^{2}\cdot{}^{\circ}C$.

3. The color image forming method according to claim 1, wherein a thickness of the heating body is in a range of about 0.1 to 6.0 mm.

4. The color image forming method according to claim 1, wherein a thickness of the film-like member is in a range of about 10 to 35 μm.

5. The color image forming method according to claim 1, wherein a transportation speed of the film-like member is in a range of about 50 to 360 mm/sec.

6. The color image forming method according to claim 1, wherein a melting point of the crystalline resin is in a range of about 50 to 120° C.

7. The color image forming method according to claim 1, wherein the non-crystalline resin comprises a polyester comprising cyclohexane dicarboxylic acid as a component thereof.

8. The color image forming method according to claim 1, wherein a glass transition temperature of the non-crystalline resin is approximately 40° C. or more.

9. The color image forming method according to claim 1, wherein a softening point of the non-crystalline resin is in a range of about 60 to 90° C.

10. The color image forming method according to claim 1, wherein a ratio of the crystalline resin to the non-crystalline resin is in a range of approximately 5/95 to 70/30 by mass ratio.

11. The color image forming method according to claim 1, wherein a peak temperature of a maximum endothermic-peak of the releasing agent is in a range of about 50 to 110° C.

12. The color image forming method according to claim 1, wherein inside of the toner particle, the crystals of the crystalline resin and the crystals of the releasing agent coexist in a form that the crystals of the crystalline resin and the crystals of the releasing agent are included as island structures and the non-crystalline resin is included as a sea structure; the shape of the crystalline resin crystals is block-shaped; and a longer side length of the crystals of the releasing agent is in a range of about 0.5 to 1.5 μm.

13. The color image forming method according to claim 12, wherein an aspect ratio of the crystalline resin crystals defined by a shorter side length of the crystalline resin crystals relative to a longer side length of the crystalline resin crystals is in a range of about 0.6 to 1.0.

14. The color image forming method according to claim 1, wherein a volume average particle diameter of the toner particle is in a range of about 3 to 9 μm.

15. The color image forming method according to claim 1, wherein a shape factor SF1 of the toner particle is in a range of about 110 to 140.

16. The color image forming method according to claim 1, wherein the color toner is formed by a method comprising:

aggregating respective particles in a releasing agent dispersion by using aluminum ions in a mixture that is obtained by mixing a colorant dispersion, the releasing agent dispersion, and a resin particle dispersion comprising crystalline resin particles and first non-crystalline resin particles, so as to form aggregated particles;

adhering second non-crystalline resin particles to the aggregated particles; and coalescing the second non-crystalline resin particles to the aggregated particles by terminating growth of the aggregated particles adhered to the second non-crystalline resin particles and then heating to a temperature which is equal to or higher than a glass transition temperature of the second non-crystalline resin particles, wherein:

an average diameter of each of the crystalline resin particles, the first non-crystalline resin particles and the second non-crystalline resin particles is equal to or less than 1 μm; and the second non-crystalline resin particles have a different solubility parameter SP value from that of the aggregated particles.

* * * * *